US007874529B2

(12) United States Patent
Klemm et al.

(10) Patent No.: US 7,874,529 B2
(45) Date of Patent: Jan. 25, 2011

(54) DECK AND PIER ACCESSORIES AND MOUNTING ASSEMBLIES

(75) Inventors: Kurt W. Klemm, Rhinelander, WI (US); Gregory J. Books, Omro, WI (US); Greg Macheel, Rancho Palos Verdes, CA (US)

(73) Assignee: Pilgrim Innovations, LLC, Omro, WI (US)

( * ) Notice: Subject to any disclaimer, the term of this patent is extended or adjusted under 35 U.S.C. 154(b) by 724 days.

(21) Appl. No.: 11/799,995

(22) Filed: May 3, 2007

(65) Prior Publication Data

US 2007/0256612 A1 Nov. 8, 2007

Related U.S. Application Data

(60) Provisional application No. 60/797,317, filed on May 3, 2006.

(51) Int. Cl.
*A47G 29/00* (2006.01)

(52) U.S. Cl. ..... 248/126; 248/241; 248/220.1; 248/298.1

(58) Field of Classification Search ..... 248/118.5, 248/424, 536, 220.1, 298.1, 126, 122.1, 227.2, 248/241
See application file for complete search history.

(56) References Cited

U.S. PATENT DOCUMENTS 0,416,755 A 12/1889 Schoenike
1,932,483 A * 10/1933 Ritz Woller ..... 248/298.1
2,731,225 A * 1/1956 Cayo ..... 248/536
3,511,106 A * 5/1970 Deeby ..... 74/501.6
3,903,633 A 9/1975 Hutcherson
4,235,409 A 11/1980 Cummings
5,458,395 A 10/1995 Skarda, Jr.
5,538,212 A * 7/1996 Kennedy ..... 248/215
5,560,145 A 10/1996 Anderson
5,632,112 A 5/1997 Steinborn
5,979,352 A 11/1999 Pearcy et al.
6,042,064 A * 3/2000 Hong ..... 248/118.5
6,435,186 B1 * 8/2002 Klemm ..... 128/845
6,454,224 B1 * 9/2002 Nogueira ..... 248/118.5
6,752,453 B1 * 6/2004 Yapp ..... 297/215.14
2002/0020797 A1 * 2/2002 Artz ..... 248/424
2003/0183236 A1 * 10/2003 Klemm ..... 128/845
2004/0226567 A1 * 11/2004 Klemm ..... 128/845

* cited by examiner

*Primary Examiner*—Terrell Mckinnon
*Assistant Examiner*—Bradley H Duckworth
(74) *Attorney, Agent, or Firm*—Thomas J. Connelly; Thomas D. Wilhelm; Wilhelm Law, S.C.

(57) ABSTRACT

A recreational accessory and corresponding mounting assembly is disclosed which is adapted and configured for use in combination with a substrate, such as a pier, dock, deck, porch, staircase, etc. The mounting assembly is secured to the substrate and the recreational accessory is removably attached to the mounting assembly. In the complete assemblage, the mounting assembly is optionally cantilevered outwardly beyond the perimeter of the substrate. Accordingly, the recreational accessory does not occupy any surface area of the substrate.

11 Claims, 9 Drawing Sheets

DECK AND PIER ACCESSORIES AND MOUNTING ASSEMBLIES

FIELD OF THE INVENTION

This invention relates to a recreational accessory or device. More specifically this invention relates to recreational accessories and mounting assemblies adapted and configured for use therewith. By "recreational accessories" it is meant various objects, items, articles, and/or devices which are commonly used in recreational settings, although these items can serve non-recreational functions as well.

BACKGROUND OF THE INVENTION

Recreational accessories can include, but are not limited to, tables, chairs, benches, storage platforms, storage boxes, coolers, grills, flags and flagpoles, lighting fixtures, trash receptacles, and/or others. Such recreational accessories are commonly used on piers, docks, decks, balconies, porches, etc. or upon or adjacent to other structures associated therewith. Unfortunately, some recreational accessories are relatively large, bulky, heavy, and/or cumbersome and the structures, such as piers, decks, stairs, etc. have limited usable surface areas. Accordingly, when using or storing recreational accessories upon such surfaces, the recreational accessory occupies some of the limited surface area thereof. Correspondingly, when a recreational accessory is stored or used on a pier, deck, stairs, etc., there is relatively less space and surface area for the users to move about. In addition, the recreational accessory can present trip hazards, other hazards, and/or other dangerous situations, to the users of such structures.

Also, there are occasions in which a user desires to use a plurality of recreational accessories simultaneously, or sequentially, whereby the user places more that one desired recreational accessory upon the pier, deck, stairs, etc. In so doing, the user further compromises the scarcity of the surface area of the structure or increases the hazards to those upon such structures.

Recreational accessories which extend outwardly beyond the perimeter of a pier, deck, stairs, etc. are typically supported by way of downwardly extending legs which extend downwardly from the accessory and into a lake-bottom or river-bottom when used in combination with a pier, or into a lawn or a landscaped surface when used in combination with a deck. The downwardly extending legs are particularly susceptible to damage, be it from oxidation or corrosion to the portion which is submerged under water, or from impact from such things as, depending on the particular application, boats, lawn mowers, pedestrians, and others.

Nevertheless, there are times when it is desirable to temporarily have a recreational accessory positioned over a structure. One example of this is when one is loading or unloading a cooler. However, most of the time, it is desirable to have the accessory removed from the surface of the structure so as to provide additional space for the people who will occupy the structure.

Therefore, there are times when it is desirable to provide a recreational accessory and mounting assembly, adapted and configured to generally not occupy any of the surface area of the structure. It is also desirable to provide a recreational accessory and mounting assembly which can be cantilevered outward beyond the perimeter of a structure.

SUMMARY OF THE INVENTION

Briefly, this invention relates to a recreational accessory and a corresponding mounting assembly. The recreational accessory and mounting assembly is adapted and configured for use in combination with a substrate. The substrate can be a pier, a dock, a deck, a porch, a staircase, etc. The mounting assembly is secured to the substrate and the recreational accessory is removably attached to the mounting assembly. In the complete assemblage, the mounting assembly is cantilevered outwardly beyond the perimeter of the substrate. Accordingly, the recreational accessory does not occupy any surface area of the substrate.

In one embodiment, the recreational accessory and mounting assembly includes a mounting mechanism secured to a substrate where the substrate is immobile, selectively immobile, mobile, or otherwise. The recreational accessory is movably mounted to the mounting mechanism such that the recreational accessory is movable between a first position and a second position. In the first position, the recreational accessory is not superposed or aligned over the substrate, and in the second position, the recreational accessory is superposed or aligned over the substrate.

In a second embodiment, the recreational accessory and mounting assembly, includes a mounting mechanism mounted to a substrate. The substrate can be mobile, immobile, or be selectively immobile. The substrate also has an upper surface and an outermost edge surface. The recreational accessory mounted to the mounting mechanism can be cantilevered laterally outwardly beyond the outermost edge surface of the substrate.

In a third embodiment, the recreational accessory and mounting assembly includes a receiving member having an upper portion, a lower portion, and an opening which extends into at least one of the upper and lower portions. The opening extends into a cavity formed in a receiving member. The cavity has a length dimension, a width dimension, and a thickness dimension. An insertion plate having a length dimension, a width dimension, a front surface and a back surface with a thickness dimension; and an elongated neck attached to and extending generally outwardly from the front surface of the insertion plate; the insertion plate removably housed in the receiving member cavity.

The general object of this invention is to provide a recreational accessory and mounting assembly that will increase the useable space available on a substrate, such as pier, dock, deck, staircase, etc. A more specific object of this invention is to provide a recreational accessory and mounting assembly that can support or store items away from the surface area of the substrate.

Another object of this invention is to provide a recreational accessory and mounting assembly which is devoid of support or mounting structure which communicates with the ground, a lake-bottom, a river bottom, or elsewhere not connected to a pier, dock, deck, staircase, etc.

A further object of this invention is to provide a recreational accessory and mounting assembly which enable a user to move the recreational accessory, to different positions, with respect to the substrate without physically interfering with the upper surface of the structure.

Still further, an object of this invention is to provide a recreational accessory and mounting assembly which enable a user to removably attach the recreational accessory to the mounting assembly.

Still further, an object of this invention is to provide a recreational accessory and mounting assembly which enable a user to selectively exchange a first accessory for a second accessory upon a substrate without requiring the user to correspondingly exchange the mounting assembly used therewith.

Other objects and advantages of the present invention will become more apparent to those skilled in the art in view of the following description and the accompanying drawings.

DETAILED DESCRIPTION OF THE INVENTION

Figure 1:
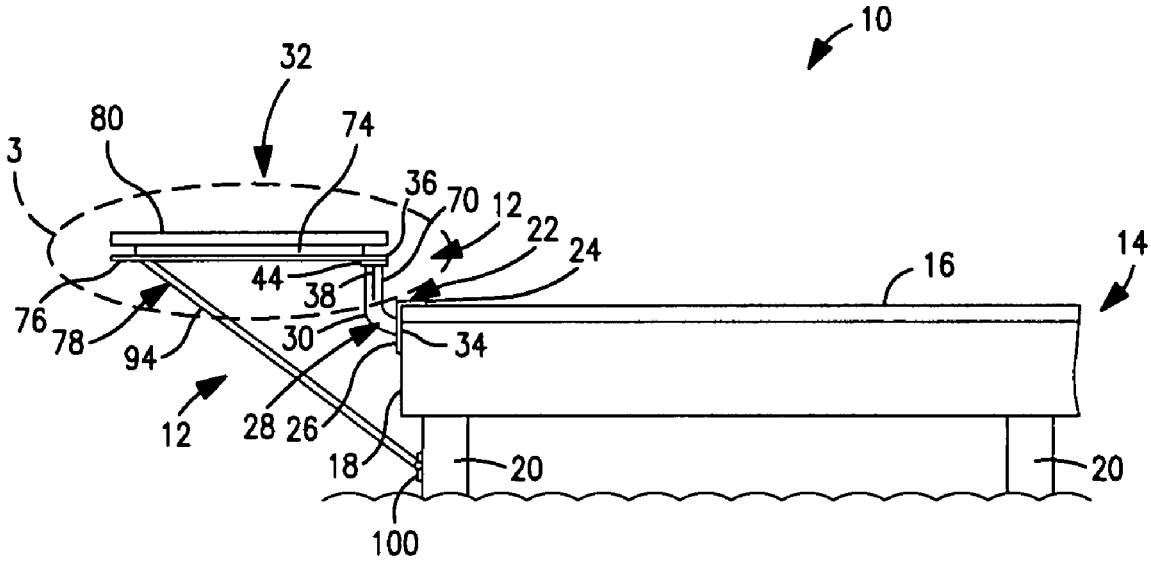
FIG. 1 is a side elevation view of a recreational accessory and mounting assembly attached to a pier or dock.

Referring to FIG. 1, a combination recreational accessory and mounting assembly 10 is shown. The recreational accessory and mounting assembly 10 includes a mounting assembly 12 which is designed to be secured to a suitable substrate 14. The substrate 14 can be a pier, dock, break wall, or other structure which extends out into a pond, lake, river, creek or some other body of water. The substrate 14 can also be a deck, a porch, a patio or some other structure which extends out into a yard, lawn or over some other piece of ground. Furthermore, the substrate 14 can be a set of stairs, a staircase, steps, a ladder or some other object to which one wishes to attach something. It should be understood that the substrate 14 can be mobile or immobile. Desirably, the substrate 14 is immobile. However, the substrate 14 could be a boat or wagon which is mobile either by having its own engine or by being towed by a motorized vehicle.

The substrate 14 can be formed from a variety of suitable materials, which include but are not limited to: concrete, brick, stone, masonry, wood, plywood, lumber, particle board, a metallic material such as metal, steel, aluminum, rubber, a polymeric material such as plastics, a composite formed from two or more materials, a closed cell foam, a hard foam, as well as other structural materials known to those skilled in the art.

The recreational accessory and mounting assembly 10 enable a person to install or attach a recreational accessory upon or to the substrate 14. The recreational accessory and mounting assembly 10 allows the usable surface area of the substrate 14 to be uninhibited. In other words, the recreational accessory and mounting assembly 10 present an insignificant or negligible footprint upon the usable surface area of the substrate 14 such that the substrate 14 retains essentially all of its usable surface area.

Figure 2:
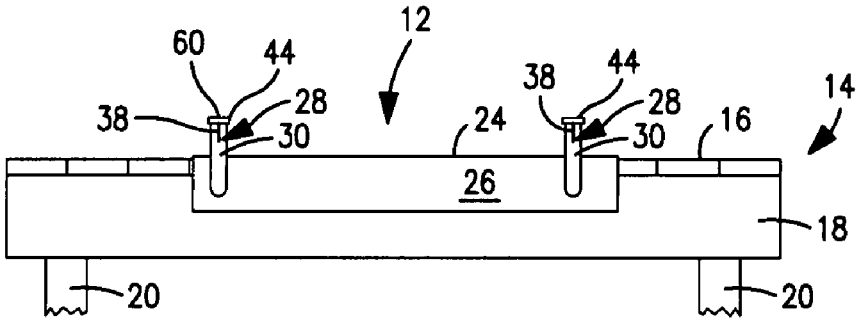
FIG. 2 is a front elevation of the mounting assembly shown in FIG. 1.

For clarity purposes only, the substrate 14 will be described as being a pier or a dock onto which the recreational accessory and mounting assembly 10 is attached. The pier or dock 14 includes an upper surface 16 and an outer surface 18 which is situated adjacent to the upper surface 16. The pier or dock 14 will commonly contain a plurality of pilings or structural members 20. The pilings or structural members 20 can be driven into the earth as a foundation or support for the pier or dock 14. In this case, the pilings or structural members 20 will extend down into the water and be pounded or driven into the bottom sediment of the body of water. Alternatively, the pier or dock can be floating on the water and will not contain any pilings. In still another alternative, the pier or dock 14 can be floating on the water and include pilings or structural members 20 that are not driven into the soil located below the water. For example, the pilings or structural members 20 will rest on the soil located beneath the water. Still further, the pier or dock 14 can be removably placed over the water and can rest on the water or the ground beneath the water if the water is only a few inches deep. Referring now to FIGS. 1 and 2, the mounting assembly 12 includes a first member 22 having a first portion 24 secured to the upper surface 16 of the pier or dock 14 and a second portion 26 extending outward from the first member 22. The second portion 26 is positioned adjacent to the outer surface 18 of the pier or dock 14. The mounting assembly 12 also includes a second member 28 which extends outward from the first member 22. As depicted, the second member 28 is secured to the second portion 26 of the first member 22 such as by a weld or other suitable connection known to those skilled in the art. Desirably, the first member 22 of the mounting assembly 12 is an L-shaped bracket, such as an angle iron. However, the first member 22 can be any desired shape depending on the exterior shape and configuration of the pier or dock 14 to which it is to be attached.

The first portion 24 of the first member 22 is a generally rigid, planar, elongated member. The first portion 24 extends generally parallel to and along a portion of the upper surface 16 of the pier or dock 14. The first portion 24 has an upper surface, a lower surface, an inwardly facing edge and an outwardly facing edge.

The second portion 26 of the first member 22 is a generally rigid, planar, elongated member which extends generally parallel to and along a portion of an outer surface 18 of pier or dock 14. As shown, the second portion 26 extends downwardly from the first portion 24. The second portion 26 has an inwardly facing surface, and outwardly facing surface, an upper edge and a lower edge. The lower edge of the second portion 26 faces toward the water and the upper edge or a portion of the second portion 26 located adjacent to the upper edge, is attached to the outwardly facing edge of the first portion 24. Thus, the combination of the first portion 24 and the second portion 26 define an L-shaped profile for the first member 22.

Still referring to FIGS. 1 and 2, the second member 28, also referred to as an attachment member, is shaped as an elbow or neck. The second member 28 is an elongated, angled or bent member. The second member 28 can be hollow or solid. Desirably, the second member 28 is a hollow tubular member. The second member 28 can be angled at any desired angle from between 1 degree to 180 degrees relative to the outer surface 18 of the pier or dock 14. Desirably, the second member 28 is angled from between about 10 degrees to about 145 degrees relative to the outer surface 18 of the pier or dock 14. More desirably, the second member 28 is angled from between about 45 degrees to about 110 degrees relative to the outer surface 18 of the pier or dock 14. Even more desirably, the second member 28 is angled from between about 60 degrees to about 90 degrees relative to the outer surface 18 of the pier or dock 14. Even more desirably, the second member 28 is angled at about 45 degrees, at about 60 degrees, or at about 90 degrees relative to the outer surface 18 of the pier or dock 14.

As stated above, the second member 28 can be hollow and have a circumferential outer wall 30. The second member 28 is shown projecting upward and outward away from the pier or dock 14. Alternatively, the second member 28 could extend downward away from the upper surface 16 of the pier or dock 14. The second member 28 is adapted and configured to be easily and quickly removed and/or interchanged so as to allow or permit one or more recreational accessories 32 to be attached to it. The phrase "recreational accessory" is used herein to describe any item that one wishes to attach or secure to the pier or dock 14. The item itself does not have to be recreational in nature. Examples of recreational accessories 32 include but are not limited to a shelf, a table, a support, a storage box, a tray, a grill, a cooking apparatus, a lighting fixture, a light, a flagpole, a flag, a banner, a torch, a trash receptacle, etc.

Still referring to FIGS. 1 and 2, the second member 28 has a first end 34 and a second end 36. The first end 34 is connected or secured to the second portion 26 of the first member 22 and the second end 36 is removably attached to the recreational accessory 32. The second member 28 is depicted as an elbow having two generally straight portions with a curved or bent portion located therebetween. The second member 28 therefore has an arcuate profile. Alternatively, the second member 28 could have an S-shaped or W-shaped profile or any non-linear profile one desires. If desired, the second member 28 can have a cavity formed therein which extends axially into at least one of the first and second straight portions and can extend through the entirety thereof. Alternatively, the second member 28 can be devoid of a curved or arcuate section and be a linearly shaped member.

The first end 34 of the second member 28 is attached to the outer surface 18 of the second portion 26 of the first member 22. The first straight section of the second member 28 extends generally linearly and perpendicularly away from the first member 22 and transitions into the arcuate section which curves about a radius and transitions into the second straight section. The second straight section of the second member 28 extends generally upwardly away from the remainder of second member 28 and terminates at the second end 36. The second end 36 is located farther away from the first member 22 and from the pier or dock 14.

The second end 36 of the second member 28 can optionally contain a slit 38. The slit 38 can extend radially through the circumferential outer wall 30 so that it is aligned perpendicular to the second end 36. The slit allows the second end 36 to have a degree of flexibility when another member is inserted into it. The slit 38 can vary in thickness and length. Desirably, the slit 38 is between from about 0.25 inches in length to about 1 inch in length. The thickness of the slit 38 can be from about 0.1 millimeters to several millimeters. The slit 38 generally disrupts the continuity of the circumference of the circumferential sidewall at the second end 36 of the second member 28. The void area of the slit 38 and the properties and characteristics of the second member 28 enable the second member 28, in which the slit 38 is formed, to flex. The radial inward and/or outward expansion and/or contraction of the second end 36, whereby the circumference of the second end 36 can become relatively larger or smaller permits a cooperating member to be easily inserted into or withdrawn from the second end 36. Namely, the second end 36 can expand outwardly to receive another component of the recreational accessory 32 therein. Alternatively, the second end 36 can be compressed inwardly to be inserted into another component of the recreational accessory 32.

Figure 3:
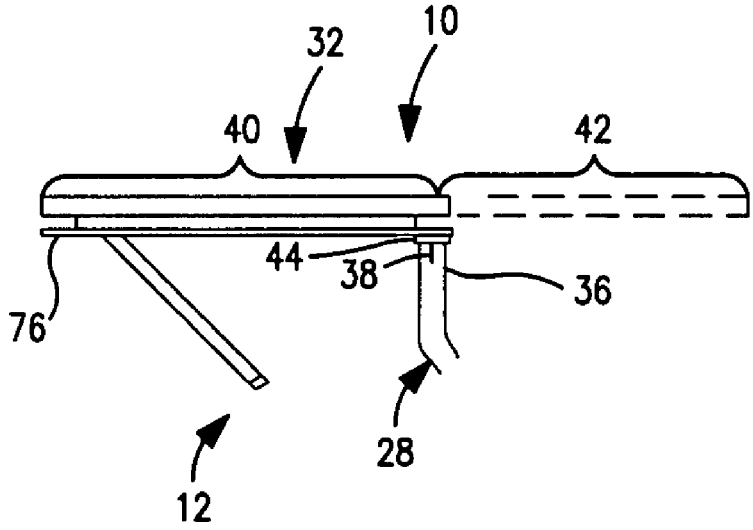
FIG. 3 is a side elevation view of the mounting assembly shown in FIG. 1 indicating in dashed lines that the recreational accessory can be moved from a first position to a second position.

Still referring to FIG. 3, the recreational accessory and mounting assembly 10 further includes the recreational accessory 32 which is movably mounted to the second member 28 of the mounting assembly 12. The recreational accessory 32 is movable between a first position 40 and a second position 42. In the first position 40, the recreational accessory 32 is not superposed over the substrate 14 and in the second position 42, the recreational accessory 32 is superposed or aligned over at least a portion of the substrate 14.

Referring now to FIGS. 1-6, a securing device 44, such as a clamp, is positioned about the second end 36 of the second member 28. The securing device 44 is adapted and configured to, alone or with the aid of other components, secure the recreational accessory 32 to the second member 28. The securing device 44 extends around a major portion, optionally a minor portion, of the circumference of the outer wall 30 of the second member 28. The securing device 44 can be designed to squeeze, clamp, tighten, grip, and/or otherwise be easily and quickly secured to the second member 28. A variety of hardware is suitable for use as the securing device 44.

Examples of such hardware includes, but is not limited to, various pipe clamps, tubing clamps, hose clamps, set-screws, insertable pins, bolts, keys, and/or others.

The securing device 44 can be manipulated between a first position and a second position. In the first position, the securing device 44 is generally locked, whereby it locks and/or otherwise fixes, for example, a recreational accessory 32 to the second member 28. In the second position, the securing device 44 is generally unlocked, whereby it generally permits movement between, for example, the recreational accessory 32 and the second member 28.

Figure 17:
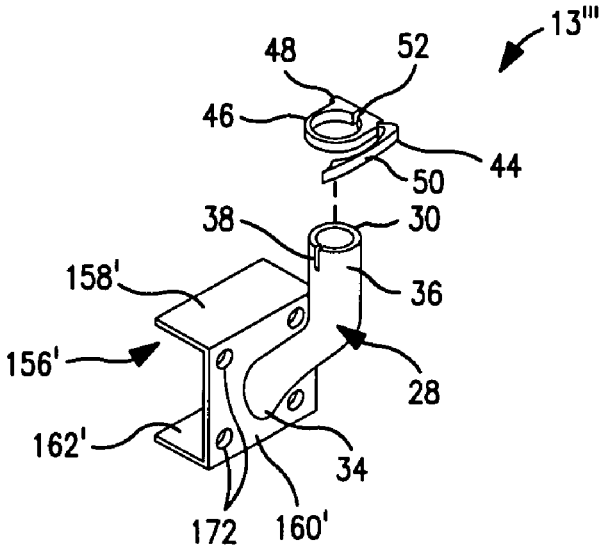
FIG. 17 is a perspective view of still another embodiment of a mounting assembly employing a C-shaped channel bracket and an attachment member secured to a second portion thereof.

Referring to FIGS. 7 and 17-19, the securing device 44 is depicted as a quick release clamp. In FIG. 17, the securing device 44 includes a clamp body 46, a clamp bolt 48, and a clamp arm 50. The securing device 44 can be manipulated between at least a first, relaxed, configuration and a second, clamped configuration.

The clamp body 46 is generally annular in shape. The clamp body 46 has first and second terminal ends, which are located adjacent to each other. The first and second ends of the clamp body 46 are spaced from each other by a clamp space 52. The magnitude of the distance between the first and second ends, which defines the clamp space 52, is not constant. Rather, the magnitude of the distance of the clamp space 52, at any particular point in time, depends on the exact configuration, and utilization of the securing device 44 at that particular point in time. As one example, when the securing device 44 is in the relaxed state, clamp space 52 is relatively large. Whereas when the securing device 44 is in a clamped state, the clamp space 52 is relatively small.

The clamp body 46 can be an arcuate band which extends circularly around in an arc and connects the first and second terminal ends of the clamp body 46. A through bore (not shown) passes generally through a medial portion of the clamp body 46 and is sized, adapted, and configured, to close or open the clamp space 52. The clamp body 46 is designed to concentrically slide over and surround portions of the second member 28 and a projection 54 which extends downward and away from the recreational accessory 32, see FIG. 8. The projection 54 can be a hollow or solid rod or arm which is sized to enter or overlap the second member 28. Desirably, the projection 54 is an elongated, tubular member that is sized to be received into the open second end 36 of the hollow second member 28. However, it should be evident to those skilled in the art that the projection 54 can have various geometrical cross-sectional configurations which will mate or engage with the geometrical configuration of the second member 28.

A relatively smaller diameter, bolt receiving, through bore (not shown) passes through each of the first and second terminal ends of the clamp body 46. This smaller diameter bolt is generally aligned perpendicular to the larger diameter bore which passes medially through the clamp body 46.

The clamp bolt 48 passes axially through each of the bolt receiving though bores of the first and second clamp body ends. The clamp bolt 48 includes a head, at one end, which has a diameter of relatively larger magnitude than the magnitude of the bore diameter of the bolt receiving through bore. Accordingly, the outwardly facing surface of the first terminal end of the clamp body 46 provides a shoulder, or other mechanical interface, which mechanically prevents the bolt head from passing into and through the bolt receiving bore. The other end of the clamp bolt 48 includes a portion which extends outwardly beyond the clamp body 46 and is adapted and configured to interface with the clamp arm 50.

The clamp arm 50 is elongated, illustrated as slightly arcuate, and has first and second ends. The first end of the clamp arm 50 includes a cavity extending thereinto, optionally, therethrough. This cavity receives therein the portion of the clamp bolt 48 which extends outwardly beyond the second terminal end of the clamp body 46. The second terminal end of the clamp body 46 and the first end of the clamp arm 50 are located adjacent to each other and the clamp body 46 and the clamp arm 50 are connected to each other by way of the clamp bolt 48.

A pin (not shown) extends through the first end of the clamp arm 50 and extends radially through the portion of the clamp bolt 48 which extends into the first end. The pin enables the clamp arm 50 to pivot about it, defining an axis of pivotation, whereby the clamp arm 50 is pivotably connected to the clamp bolt 48. By pivoting the clamp arm 50 about the pin, a person can manipulate the securing device 44 between a relaxed state or configuration and a clamped state or configuration.

When a person manipulates, for example, pivots the clamp arm 50, the first end of the clamp arm 50 interfaces with the second terminal end of the clamp body 46. As desired, the outer surface of the clamp body's 46 second terminal end and the outer surface of the first end of the clamp arm 50 have cooperating profiles and/or other characteristics, which enable the clamp arm 50 to be releasably "locked-down" with respect to the clamp body 46. Suitably cooperating profiles and/or other characteristics include, but are not limited to, various corresponding ramped surfaces, corresponding detent structures, and/or other characteristics and configurations which enable the clamp arm 50 to snap-lock, cam-lock, and/or otherwise releasably lock-down with respect to the clamp body 46.

When the securing device 44 is in the locked-down, clamped state or configuration, the through bore which passes through the securing device 44 realizes a relatively lesser diameter. Correspondingly, the inner circumferential surface of the securing device 44 urges a portion of second member 28, which it communicates with, generally inwardly, relatively reducing the diameter of the end of the second member 28. In other words, when a person locks-down the clamp arm 50, the clamp body 46 concentrically squeezes the second member 28, flexing the circumferential outer wall 30 radially inwardly, which decreases the width of the slit 38. Correspondingly, the inner circumferential surface of the second member 28 squeezes against the outer circumferential surface of the projection 54 which has been inserted into the second end 36 of the second member 28. Thus the securing device 44 removably, grippingly, frictionally, or otherwise, secures the projection 54 to the second member 28.

Referring now to FIGS. 1, 2 and 4-6, the entire assemblage of the mounting assembly 12 enables various recreational accessories 32 to be secured, removed, moved, and/or otherwise, mounted to the pier or dock 14. The first member 22 of the mounting assembly 12 is mounted to the pier or dock 14 such that a lower surface of first portion 24 interfaces with the upper surface 16 of the pier or dock 14. Likewise, the inwardly facing surface of the second portion 26 interfaces with the outer surface 18 of the pier or dock 14.

The interfacing of the first portion 24 with the pier or dock 14 provides, at least in part, the load bearing capacity of the first member 22. The interfacing of the second portion 26 with the pier or dock 14 provides, at least in part, a means by which the recreational accessory and mounting assembly 10 resists rotationally falling into the water when the recreational accessory 32 is cantilevered outwardly beyond the pier or dock 14. As desired, the first portion 24 and/or the second portion 26 have one or more bores 56 which extend therethrough, see FIG. 7. Suitable hardware extends through the bores 56 so as to mount the first member 22 to the pier or dock 14. Such hardware includes, but is not limited to, nails, bolts, screws, rivets and/or other fasteners and hardware. In lieu of, or in addition to, such suitable hardware, the first member 22 can be mounted to the pier or dock 14 by other suitable mounting methods, including, but not limited to, welding, adhering, and/or others.

Referring now to FIGS. 4, 5, 9-11, 13 and 15-17, other suitable mounting mechanisms include, but are not limited to, various mechanisms which have one or more second members 28 affixed and/or generally permanently attached to the first member 22. Optionally, the second members 28 can be removably attached to the first member 22, which in turn is mounted to the pier or dock 14. It should be noted that the recreational accessory and mounting assembly 10 can include one or more differently configured mounting assemblies 12, if desired.

Figure 4:
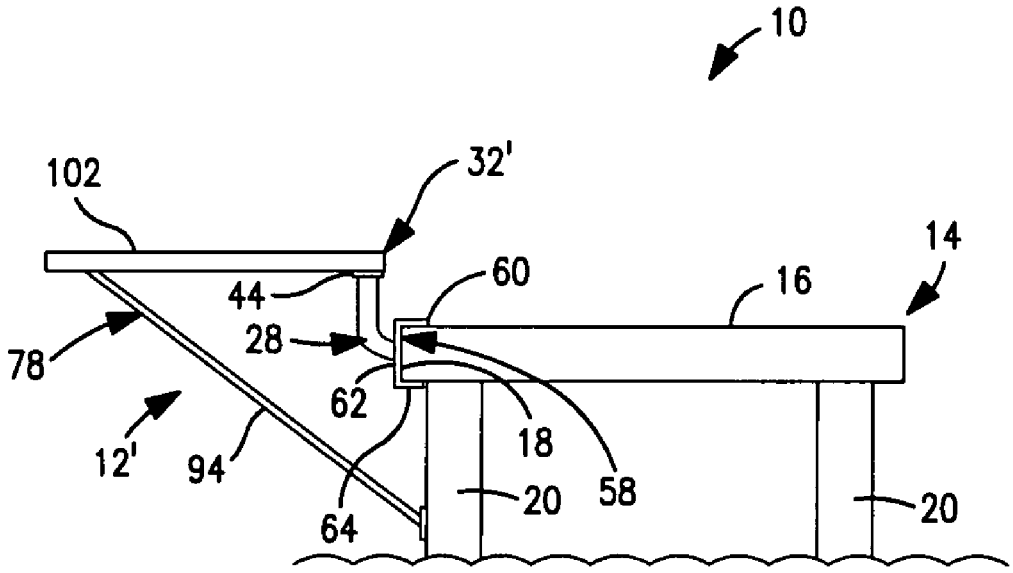
FIG. 4 is a side elevation view of another embodiment of a recreational accessory and mounting assembly in the form of a shelf.
Figure 5:
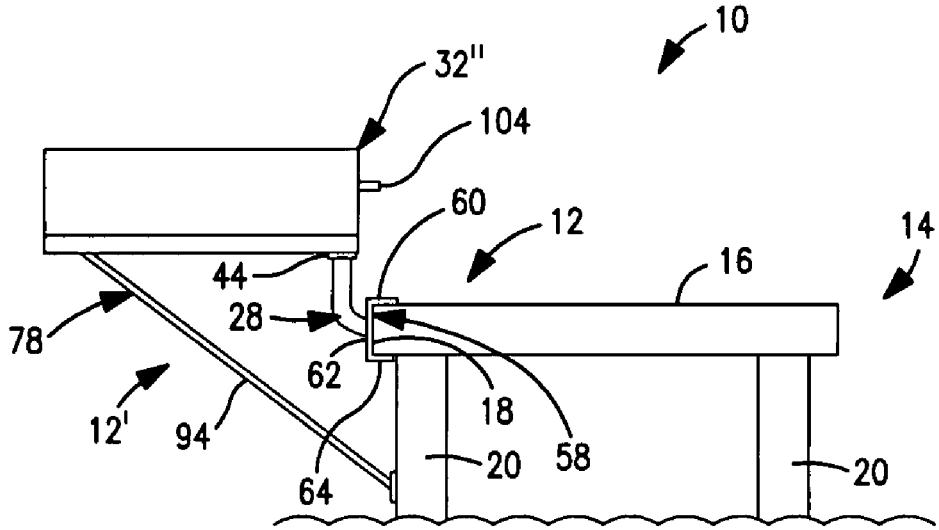
FIG. 5 is a side elevation view of still another embodiment of a recreational accessory and mounting assembly in the form of a storage locker.
Figure 6:
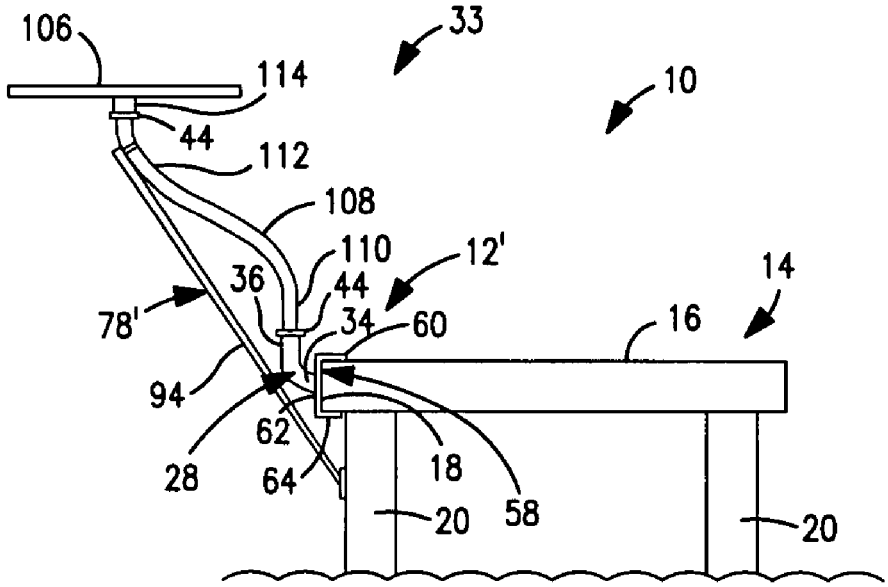
FIG. 6 is a side elevation view of still another embodiment of a recreational accessory and mounting assembly in the form of an elevated table.
Figure 7:
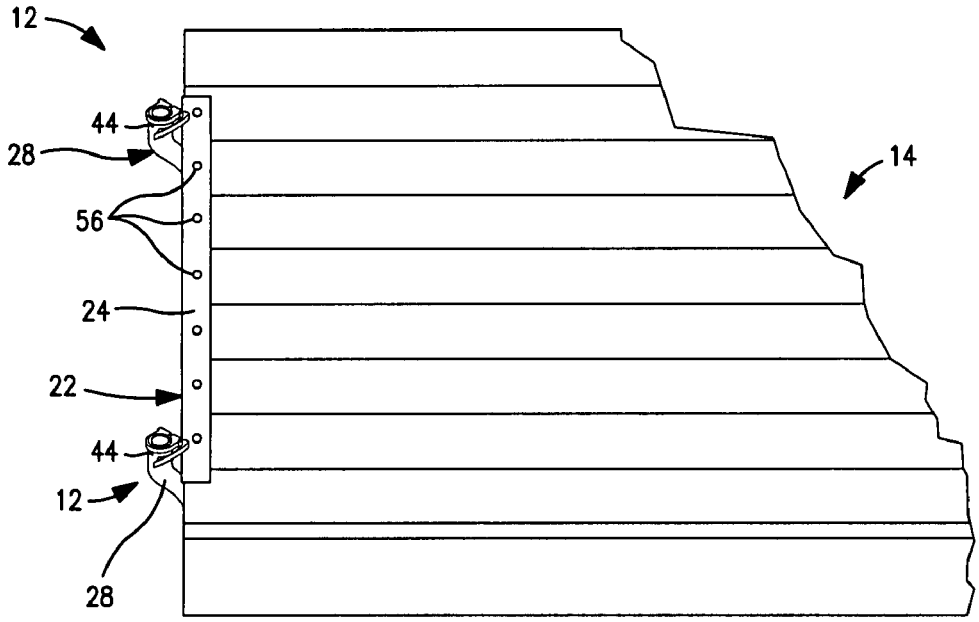
FIG. 7 is a perspective view of the mounting assembly shown in FIGS. 1 and 2.

Referring now to FIGS. 4-6, an alternative mounting assembly 12' is shown which replaces the L-shaped first member 22 with a C-shaped channel bracket 58. The mounting assembly 12' also includes the second member 28 and optionally, the securing device 44. The C-shaped channel bracket 58 can be a piece of "channel" stock, or any other suitable rigid member which is C-shape in profile. The C-shaped channel bracket 58 includes a first portion 60, a second portion 62, and a third portion 64.

The first portion 60 is a generally rigid, planar, elongated member and extends generally parallel to and along a portion of the upper surface 16 of the pier or dock 14. The first portion 60 has an upper surface, a lower surface, a substrate facing edge and an outwardly facing edge. The substrate facing edge generally faces toward the pier or dock 14 and the outwardly facing edge faces generally outwardly away from the pier or dock 14.

The second portion 62 is a generally rigid, planar, elongated member which extends generally parallel to and along a portion of the outwardly facing surface of the pier or dock 14 and extends downwardly from the first portion 60. The second portion 62 has an inwardly facing surface, and outwardly facing surface, an upper edge surface and a lower edge surface. The lower edge surface of the second portion 62 is approximate the water and the upper edge surface, or a portion of the second portion 62 located adjacent to its outer edge, is attached to the outwardly facing edge of the first portion 60.

The third portion 64 is a generally rigid, planar, elongated member and extends generally parallel to and along a portion of the lower surface of the pier or dock 14, generally parallel to the first portion 60. The third portion 64 has an upper surface, a lower surface, a substrate facing edge and an outwardly facing edge. The substrate facing edge generally faces toward the pier or dock 14 and the outwardly facing edge faces generally outwardly away from the pier or dock 14. The outwardly facing edge of the third portion 64 is attached to the lower edge surface of the second portion 62, whereby the first, second, and third portions, 60, 62 and 64 respectively, define a C-shaped channel bracket 58.

The second member 28 extends outwardly from the second portion 62, similar to how the second member 28 extends outwardly from second portion 26 of the first member 22 shown in FIG. 1. Alternatively, the second member 28 can extend from the C-shaped channel bracket 58 in other suitable manners which enable the second member 28 to be removably housed, held, or otherwise attached to various recreational accessories 32.

Figure 9:
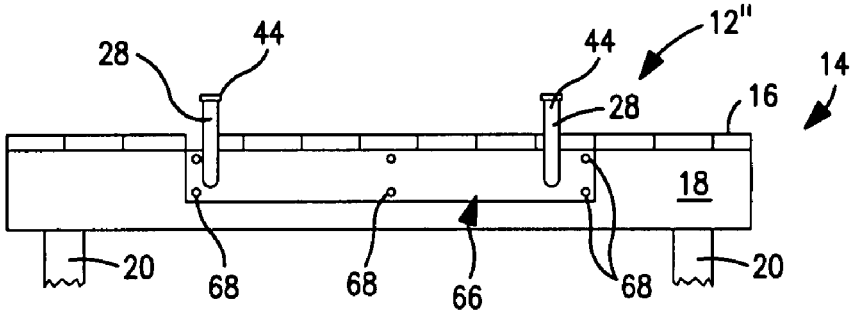
FIG. 9 is a front elevation view of a mounting assembly wherein a first member is secured to the outer surface of a pier or dock.

Referring now to FIG. 9, a mounting assembly 12" is shown which includes a mounting plate 66 and one or more second members 28. In FIG. 9, two second members 28 are depicted spaced apart from one another. The mounting plate 66 is generally planar, has an outer surface, and inner surface, and two ends which generally define a length therebetween. The mounting plate 66 extends partially along the outer surface 18 of the pier or dock 14, whereby the inwardly facing surface of the mounting plate 66 is in face-to-face communication with the outer surface 18 of the pier or dock 14. Each of the two second members 28 extends outwardly and upwardly away from the outer surface of the mounting plate 66. The two second members 28 can be spaced apart from each other at any desired distance along the length of the mounting plate 66.

A plurality of bores 68 are formed through the entire thickness of the mounting plate 66. The bores 68 are adapted and configured to accept mounting hardware therethrough so as to secure the mounting assembly 12" to the pier or dock 14. Suitable hardware includes, but is not limited to, nails, bolts, screws, rivets and/or other fasteners and hardware.

Figure 8:
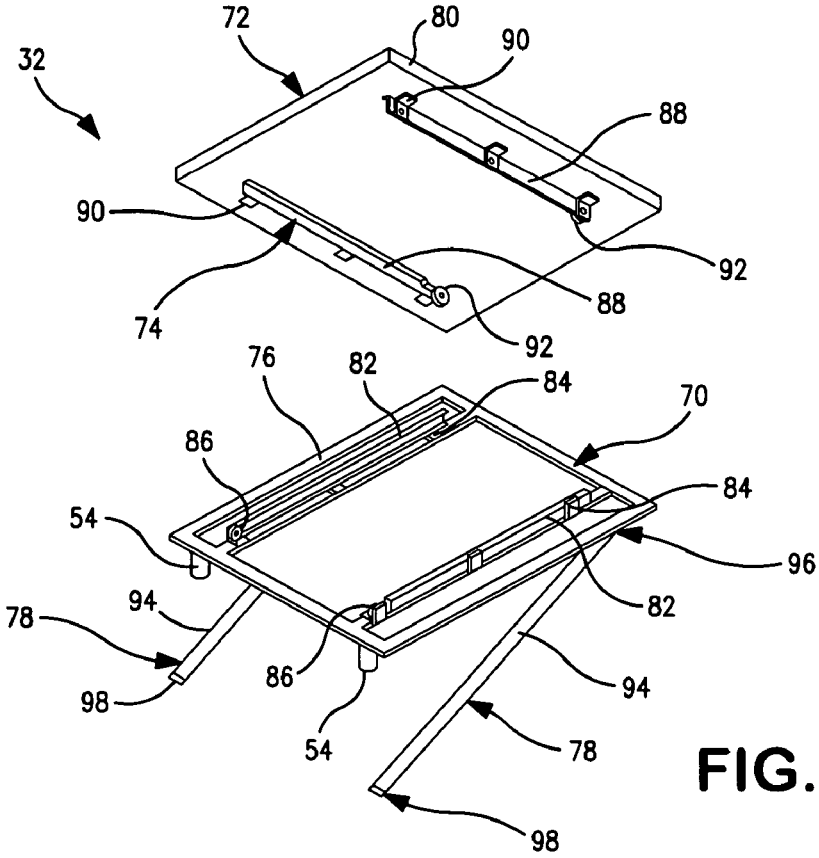
FIG. 8 is an exploded view of the recreational accessory shown in FIG. 1.

Referring now to FIGS. 1, 3 and 8, the recreational accessory 32 is depicted as a table which is adapted and configured to move between a first position 40 and a second position 42. Components of the accessory 32 can slide along a generally straight-line linear travel path, between the first and second positions, 40 and 42 respectively. This enables the recreational accessory 32 to be positioned entirely over the water away from the pier or dock 14 or to be superposed, partially or fully, over the pier or dock 14.

The recreational accessory 32 includes a lower tray assembly 70, an upper tray assembly 72, and a slide rail assembly 74. The lower tray assembly 70 includes a lower tray 76, parts of the slide rail assembly 74, a pair of anchor projections 54, and optionally, a support brace assembly 78. The upper tray assembly 72 includes an upper tray 80 and parts of the slide rail assembly 74.

The lower tray 76 is generally planar, has an upper surface, a lower surface, front and back edges, and lateral edges. The lower tray 76 is mounted, for example, cantilevered, outwardly away from the pier or dock 14. No portion of the lower tray 76 superposes the pier or dock 14. Rather, the lower tray 76, in its entirety, superposes and/or otherwise overlies the water.

The upper tray 80 is generally planar, has an upper surface, a lower surface, front and back edges, and lateral edges. The upper tray 80 is adapted and configured to move, namely linearly advance and/or regress, with respect to the lower tray 76. The lower surface of the upper tray 80 faces the upper surface of the lower tray 76. The upper surface of the upper tray 80 faces upwardly, in the opposite direction, and provides a useable surface upon which a person can, for example, use in a manner similar to a typical tabletop.

The upper tray 80 is adapted and configured to move with respect to the lower tray 76, whereby the lower tray 76 is fixed in a relatively immobile position and orientation and the upper tray 80 is relatively movable and/or otherwise mobile. In other words, the recreational accessory 32 enables a person to manipulate and move at least a portion of the recreational accessory 32 between a first position in which it generally does not superpose the pier or dock 14 and a second position in which the recreational accessory 32 does superpose at least a portion of the pier or dock 14.

Referring to FIG. 8, the slide rail assembly 74 is attached to the upper surface of the lower tray 76. The slide rail assembly 74 includes a pair of lower slide rails 82, at least one and desirably several mounting brackets 84, a pair of slide rollers 86, a pair of upper slide rails 88, at least one and desirably several mounting brackets 90, and a pair of slide rollers 92.

The above described components permit the upper tray 80 to be slideably attached to the lower tray 76.

In embodiments which include trays which are slidably moveable with respect to each other, various other suitable and well know slide mechanisms are contemplated and fully within the scope of the present invention. Such mechanisms include but are not limited to: various side-mounted, bottom-mounted drawer slides as well as other slides.

In embodiments which include trays that are otherwise movable with respect to each other, such movable components communicate with each other through, for example, suitable hardware which enables the particular desired movable relationship therebetween. As one example, in embodiments which include a first tray member that pivots or rotates with respect to a second tray member, such first and second tray members can be attached to each other by way of various hardware swivel mechanisms, pivot mechanisms, and/or other suitable hardware.

Referring again to FIGS. 1 and 8, the pair of lower slide rails 82 extends generally parallel to each other and at least partially along the length of the lower tray 76. Each of the lower slide rails 82 is generally elongated, has an inner surface, an outer surface, a lower portion, an upper portion, and is mounted and positioned generally perpendicularly upright, for example, on edge, with respect to the lower tray 76. In other words, each of the lower slide rails 82 extend partially along the length of, and perpendicularly upwardly away from, the upper surface of the lower tray 76. The pair of lower slide rails 82, and/or components affixed thereto, are adapted and configured to slidingly or otherwise cooperate with other components of the slide rail assembly 74, whereby portions of the slide rail assembly 74 linearly advance and/or regress with respect to other portions of the slide rail assembly 74.

The lower portions of the pair of lower slide rails 82 each face the upper surface of the lower tray 76. The upper portion of the pair of lower slide rails 82 each face generally the same direction as the upper surface of the lower tray 76, namely toward the upper tray 80. The upper portion of the pair of lower slide rails 82 can include a turned or perpendicularly bent portion thereof. For example, a laterally projecting rib or flange. The laterally projecting rib or flange can extend along the length of each of the lower slide rails 82, generally parallel to the lower tray 76, and toward the other respective one of the lower slide rail 82.

The mounting brackets 84 are generally L-shaped brackets and each has an upright member and a horizontal member. The upright members of the mounting brackets 84 are attached to the outer surfaces of the lower slide rails 82. The horizontal members of the mounting brackets 84 extend under and beyond each of the lower slide rails 82, toward the medial portion of the lower tray 76 and toward the other lower slide rail 82. The horizontal members of the mounting brackets 84 extend under and beyond each of the lower slide rails 82, toward the medial portion of the lower tray 76 and toward the other slide rail 82. Thus, a plurality of the mounting brackets 84 are spaced apart from each other and are attached to the pair of lower slide rails 82 to the upper surface of the lower tray 76.

The slide rollers 86 are each generally cylindrical, wheel-type members, which are rotatably mounted to one of the pair of lower slide rails 82. Namely, each of the slide rollers 86 can rotate with the inner surface of one of the lower slide rails 82, adjacent to an end of the lower slide rail 82. Each of the slide rollers 86 rotates about an axis of rotation which is generally parallel to the upper surface of the lower tray 76 and the outer circumferential surface of each of the rollers 86 is adapted and configured to interface with one of the pair of upper slide rails 88.

The pair of upper slide rails 88 extends generally parallel to each other and at least partially along the length of the upper tray 80. Each of the pair of upper slide rails 88 is generally elongated, has an inner surface, an outer surface, a lower portion, an upper portion, and is mounted and positioned generally perpendicularly upright, for example, extending downwardly on edge, with respect to the upper tray 80. In otherwords, each of the pair of upper slide rails 88 extends partially along the length of, and perpendicularly downwardly away from, the lower surface of the upper tray 80. The pair of upper slide rails 88 and/or components affixed thereto, is adapted and configured to slidingly or otherwise cooperate with other components of the slide rail assembly 74. Namely, portions of the upper slide rails 88, and/or other components of the slide rail assembly 74 communicating therewith, are adapted and configured to linearly advance and/or regress with respect to other portions of the slide rail assembly 74. This enables the pair of upper slide rails 88 and/or other components of the slide rail assembly 74 to communicate with the pair of lower slide rails 82.

The upper portions of the pair of upper slide rails 88 each face the lower surface of the upper tray 80. The lower portions of the pair of upper slide rails 88 each face generally the same direction as the lower surface of the upper tray 80, namely toward the lower tray 76. As desired, the lower portion of the pair of upper slide rails 88 can include a turned or perpendicularly bent portion. For example, a laterally projecting rib or flange which extends along the length of each of the upper rails 88. The laterally projecting rib or flange can be aligned parallel to the upper tray 80 and face toward the other upper slide rails 88.

The mounting brackets 90 are generally L-shaped brackets, each of which has an upright member and a horizontal member. The upright members of the mounting brackets 90 are attached to the outer surfaces of each of the upper slide rails 88. The horizontal members of each of the mounting brackets 90 extend outwardly away from the upper slide rails 88 toward a first outer lateral edge of the upper tray 80 and thus away from the other slide rail 88. Thus, a plurality of the mounting brackets 90 are spaced apart from each other and are attached to the upper slide rails 88 and to the lower surface of the upper tray 80.

Each of the pair of slide rollers 92 is generally a cylindrical, wheel-type member, 20 which is rotatably mounted to one of the pair of upper slide rails 88. Namely, each of the slide rollers 92 can rotate on the inner surface of one of the upper slide rails 88, adjacent to an end of the respective upper slide rail 88. Each of the slide rollers 92 can rotate about an axis of rotation which is generally parallel to the lower surface of the upper tray 80 and the outer circumferential surface of the respective slide roller 92 is adapted and configured to interface with corresponding ones of the lower slide rails 82.

In embodiments in which the lower and upper slide rails, 82 and 88 respectively, incorporate laterally projecting ribs, the ribs are adapted and configured to cooperate with the respective rollers 86 and 92 which enable corresponding ones of the lower and upper slide rails 82 and 88 to slide relative to each other. Namely, the outer circumferential surface of each of the slide rollers 86 can rotate with respect to the upwardly facing surface of the lateral rib of the respective upper slide rails 88.

The outer circumferential surface of each of the slide rollers 92 can roll on the downwardly facing surface of the lateral rib of the respective lower slide rail 82. Thus, the interfacing relationships between the slide rollers 86 and 92 and the corresponding pair of lower and upper slide rails, 82 and 88 respectively, effectively resist forces which urge the upper tray 80 upwardly away from the lower tray 76, whereby the trays 76 and 80 are locked in a sliding relationship to each other. This enables the upper tray 80 to slide with respect to the lower tray 76 while generally preventing non-desired removal of the upper tray 80 from the lower tray 76.

Thus the recreational accessory 32, namely the upper tray 80, can slide along a generally straight line travel path, between the first and second positions, 40 and 42 respectively. The upper tray 80 is adapted and configured to traverse a travel distance which corresponds to the width of the recreational accessory 32, i.e. the table. As one example, the travel distance has a magnitude of at least about 50% of the magnitude of width of the recreational accessory 32. Desirably, the travel distance has a magnitude of at least about 70% of the magnitude of the recreational accessory 32. More desirably, the travel distance has a magnitude of at least about 80% of the magnitude of the recreational accessory 32.

The slide rail assembly 74 further includes other suitable slide mechanisms as desired by the user. Examples of other slide mechanisms include various under-mount, and/or side-mount, drawer and/or other slide mechanisms such as various friction slides, snap-in friction slides, ball bearing slides, mini ball bearing slides, and/or others.

Still referring to FIG. 8, the projections 54 extend generally downwardly from the lower surface of the lower tray 76. Each of the projections 54 is adapted and configured to enable a person to removably attach the recreational accessory 32 to the mounting assembly 12. The projections 54 are generally elongated and have outer circumferential surfaces. The projections 54 are adapted and configured for removable, sliding receipt into the hollow openings of the second members 28 (Not Shown). This enables the inner circumferential surfaces of the second members 28 to grip, frictionally engage, and/or otherwise, interface with the outer circumferential surfaces of the projections 54.

Each of the pair of support brace assemblies 78 includes an elongated arm 94, an upper brace connector 96 (one of which is shown), and a lower brace connector 98. Each elongated arm 94 has first and second ends and a length defined therebetween. An upper brace connector 96 is attached to a first end of each of the elongated arms 94 and a lower brace connector 98 is attached to a second end of each of the elongated arms 94. The pair of elongated arms 94 can be omitted in some embodiments, if desired.

The upper and lower brace connectors, 96 and 98 respectively, have a hinge barrel which extends generally perpendicular to the elongated arm 94. A bore extends axially through the hinge barrel and is adapted and configured to accept mounting hardware therethrough. In the alternative to a hinge barrel, each of the upper and lower brace connectors, 96 and 98 respectively, can include a bore which extends radially through the first and second ends of the respective elongated arm 94.

Regardless of the particular configuration of the upper and lower brace connectors, 96 and 98 respectively, the upper and lower brace connectors, 96 and 98, are adapted and configured to cooperate with corresponding receiving structure secured to the pier or dock 14. For example, the receiving structure can be a mounting bracket 100, see FIG. 1. The mounting bracket 100 can include a plate which is generally planar and which is secured to the pier or dock 14. The mounting bracket 100 can also include one or more generally rigid lobes which extend outwardly from the outer surface of the plate, in other words, outwardly away from the pier or dock 14.

Each of the rigid lobes can have a bore which extends therethrough, aligned parallel to the bore which extends through the upper and lower brace connectors 96 and 98. In the complete assemblage of recreational accessory 32, the bores formed in the rigid lobes and the bores formed in the upper and lower brace connectors 96 and 98 are generally coaxially aligned with each other. This means that hardware can pass through the coaxially aligned bores and secure the support brace assembly 78 to the recreational accessory 32 and to the pier or dock 14. Suitable mounting hardware includes, but is not limited to: bolts, screws, pins, keys, rivets, and/or other hardware.

Thus, in embodiments which incorporate a support brace assembly 78, the generally rigid, durable, and/or resilient braces, arms, and/or braces transfer at least some of the load, provided by gravitational force upon the recreational accessory 32, to the pier or dock 14. As desired, the support brace assembly 78 is utilized to at least partially attenuate any tendency of the recreational accessory 32 to sag downwardly at the portion most distal to the pier or dock 14.

The support brace assembly 78 extends from the recreational accessory 32 at an angle which is less than about 90 degrees, desirably less than about 60 degrees, and more desirably, less than about 45 degrees, with respect to the bottom surface of the recreational accessory 32. The support brace assembly 78 extends at a generally acute angle toward the pier or dock 14. This enables the recreational accessory 32 to be cantilevered entirely beyond the outer surface 18 of the pier or dock 14 and be supported entirely by the pier or dock 14. This construction also allows the recreational accessory and mounting assembly 10 to be free or devoid of any support members which need to be positioned in the ground directly below it. In the case of our pier or dock 14, the recreational accessory and mounting assembly 10 does not have to include posts which pass into the water and are driven into the soil of the lake or river or other geological structure.

To assemble the recreational accessory 32 to the mounting assembly 12, a person would insert the projections 54 of the recreational accessory 32 into the second members 28. As desired, the person can secure the securing devices 44. Then the person pivots the elongated arms 94 of the support brace assembly 78, about their pivotably attachment points with the recreational accessory 32, into communication with the corresponding mounting brackets 100 and inserts the securing hardware. This last mentioned step can further include unsecuring and re-securing the securing devices 44 and/or raising, lowering, or otherwise moving the recreational accessory 32 with respect to the mounting assembly 12. This action will ensure that the lower brace connectors 98 are suitably aligned with the mounting brackets 100.

A person can remove the recreational accessory 32 from the mounting assembly 12 and replace the recreational accessory 32 with another suitable recreational accessory such as will be described later. Accordingly, the recreational accessory and mounting assembly 10 can be a multifunctional, modular, device which enables a person to exchange and utilize various recreational accessories in combination with a single, or a plurality, of mounting assemblies 12.

Turning now to FIG. 4, an alternative recreational accessory 32' is shown in the form of a fixed platform which is mounted in a cantilever fashion to the pier or dock 14. The recreational accessory 32' includes a shelf 102 which extends outwardly away from the C-shaped channel 58 and thus outwardly away from the pier or dock 14. The shelf 102 has upper and lower surfaces, a pier or dock facing portion and an outwardly facing portion. The pier or dock facing portion of the shelf 102 is located approximate the pier or dock 14 and is attached to the mounting assembly 12 by way of the downwardly extending projections 54, see FIG. 8, or by other suitable mounting means.

The upper surface of the shelf 102 provides a usable platform upon which a person can store items, or otherwise use for another purpose. The upper and lower surfaces of the shelf 102 are generally aligned parallel to each other, and each is generally aligned parallel to the upper surface 16 of the pier or dock 14. The upper and lower surfaces of the shelf 102 are elevated above a horizontal plane which is defined by the upper surface 16 of the pier or dock 14. A straight-line projected from the upper surface 16 of the pier or dock 14 and coplanar therewith, projected under the shelf 102 such that the plane of the shelf 102 is located vertically above the upper surface 18 of the pier or dock 14.

Figure 22:
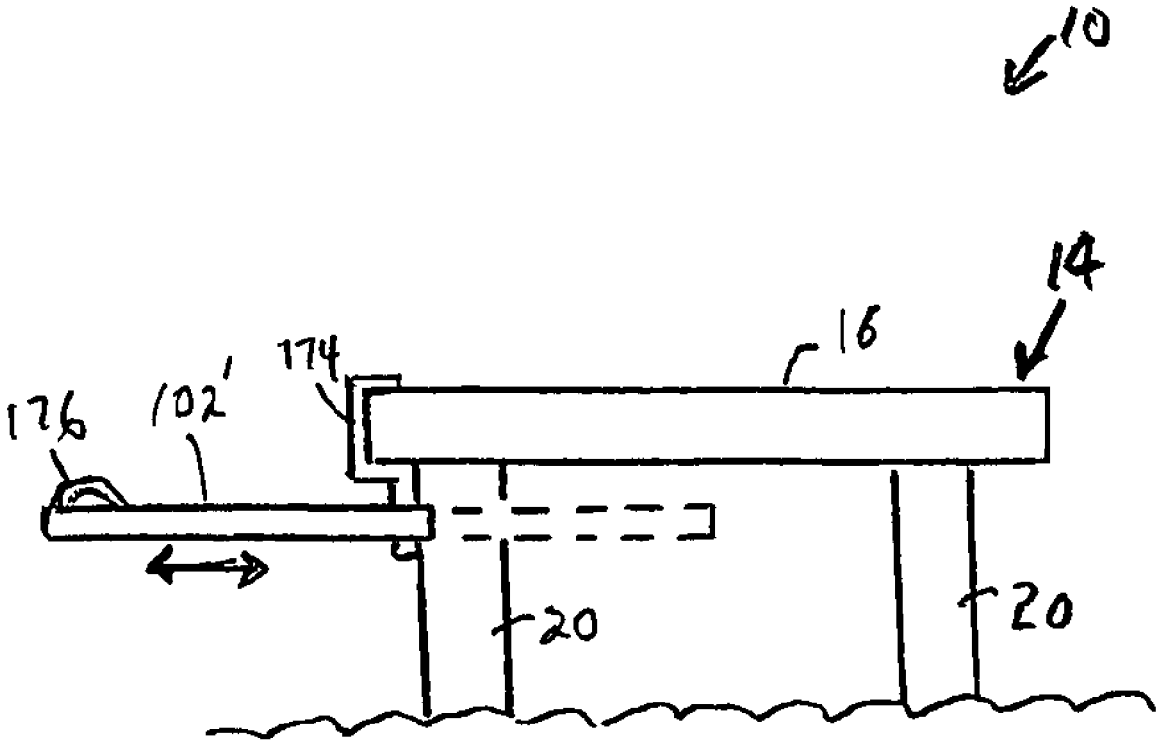
FIG. 22 is a side elevation view of another embodiment of a recreational accessory and mounting assembly in the form of a movable shelf aligned below the upper surface of a pier or dock.

Referring to FIG. 22, a movable shelf 102' is depicted that can alternatively be mounted to the pier or dock 14 by flipping the second member 28 upside down or by using an alternatively configured bracket 174. The bracket 174 allows the movable shelf 102' to be aligned at a vertical elevation below the upper surface 16 of the pier or dock 14. In addition, the bracket 174 can be constructed such that it will allow the movable shelf 102' to be pulled out away from the pier or dock 14. The movable shelf 102' can move horizontally from a first position, indicated by dotted lines, to a second position, indicated by the solid lines. In the first position, the movable shelf 102' is located beneath the pier or dock 14, while in the second position, the movable shelf 102' is cantilevered outward away from the pier or dock 14. The movable shelf 102' can slide or move parallel to the upper surface 16 of the pier or dock 14 such that it can initially be positioned directly below the pier of dock 14, what is referred to as the first position. The shelf 102' can be pulled or slid out to its second position wherein it extends outward away from the pier or dock 14 in a cantilever fashion.

The movable shelf 102' can be readily accessible to a boater who approaches the pier or dock 14. For example, once a boat is positioned adjacent to the pier or dock 14, the boater can pull out the shelf 102, located below the surface of the pier or dock 14, and reach items on the shelf 102' which are to be loaded into the boat. Alternatively, items to be removed from the boat can be placed on the pulled out shelf 102' so that they can be later retrieved by the boater or be picked up by another person on the pier or dock 14. Optionally, one or more handles 176, one of which is shown, can be secured to the shelf 102'. The handle(s) 176 can extend upwardly from an outer edge of the shelf 102' and/or back toward the pier or dock 14 whereby a user can extend or retract the shelf 102' while positioned, such as when kneeling or sitting, on the upper surface 16 of the pier or dock 14. Such a shelf 102' is especially useful when the upper surface 16 of the pier or dock 14 is located at a distance of more than 12 inches above the upper surface of the water.

In some embodiments, the plane of the shelf 102 can be positioned even with or be below the upper surface 16 of the pier or dock 14. Alternatively, portions of the shelf 102 can lie generally below the upper surface 16 of the pier or dock 14. In addition, portions of the upper surface 16 of the pier or dock 14 can be superposed over a portion of the shelf 102, if desired. Exemplary of uses in which such configuration proves beneficial are those in which the shelf 102 is adapted and configured to receive, store, or otherwise house water skis, ropes, life preservers, and/or other boating or water recreational accessories, thereby keeping such accessories conveniently stored yet off the upper surface of the pier or dock 14.

In other words, the upper surface of the shelf 102 is vertically spaced from the upper surface of the water by a first distance which has a magnitude greater than the magnitude of a second distance defined between the upper surface 16 of pier or dock 14 and the upper surface of the water. Thus, as illustrated, the recreational accessory 32' is relatively more elevated above, for example, more distal or further removed from the water than is the upper surface 16 of the pier or dock 14. Alternatively, the recreational accessory 32' can be relatively less elevated above, for example, less distal or nearer to, the water than is the upper surface 16 of the pier or dock 14. In such alternative embodiments, the second member 28 will extend generally downwardly away from the C-shaped channel 58 or other suitable substrate mounting means.

Accordingly, any suitably recreational accessory 32 or 32' can be cantilevered outwardly from the pier or dock 14 and the bottom of the recreational accessory 32 or 32' can be either located above or below a projected plane which extends in a coplanarly fashion from the upper surface 16 of the pier or dock 14. Alternatively, any suitable recreational accessory 32 or 32' can be cantilevered outwardly from the pier or dock 14 and the bottom of the recreational accessory 32 or 32' can be either relatively higher than or relatively lower than the point of attachment of the mounting assembly 12 and the pier or dock 14.

As shown, the support brace assembly 78 includes a pair of arms 94 which diagonally extend outward between the pier or dock 14 and the outwardly facing portion of the shelf 102. The pair of arms 94 provides additional load bearing support, in addition to the load bearing support provided by the mounting assembly 12. Namely, a first end of each of the pair of arms 94 is attached to the outwardly facing portion of the shelf 102 and the second end of each of the pair of arms 94 is attached to the pier or dock 14.

Utilization of the support brace assembly 78, in combination with the shelf 102, at least partially transfers the forces applied by a load placed upon the shelf 102 to the pier or dock 14. This is especially true for loads which are applied at or adjacent the outwardly facing portion of the shelf 102 or forces applied otherwise nearer the point of intersection of the support brace assembly 78 and the shelf 102. Loads applied to the shelf 102 which are closer to the point where the mounting assembly 12 is attached to the shelf 102 will be support more by the second member 28 of the mounting assembly 12.

Referring now to FIG. 5, a recreational accessory 32" is shown as a storage box or compartment having a locking mechanism 104. The storage box 32" is cantilevered outwardly beyond the outer surface 18 of the pier or dock 14. The storage box 32" is supported by the pier or dock 14 but not by any post driven into the lake or river bed. The storage box 32" includes a bottom wall, a top wall, a plurality of sidewalls, a door, and the locking mechanism 104. The bottom wall, the top wall, the plurality of sidewalls, and the door, generally define an enclosure structure and a storage compartment cavity therebetween. The door enables a person to access the inside of the storage box 32" and to store articles therein. By opening the door, a person can gain entrance into the storage box 32" to either insert or to remove articles therefrom.

The locking mechanism 104 communicates with the door and with a generally non-movable portion of the storage box 32" such as one of the bottom wall, top wall, and sidewalls, and is adapted and configured to selectively secure the door in a closed position. Those skilled in the art are well aware of suitable mechanisms and devices for use as the locking mechanism 104. Such suitable mechanisms and devices include, but are not limited to: hasps, hasp-locks, hasp-and-staples, padlock-eyes, padlocks, deadbolts, lockable knobs, lockable levers, and/or others.

Alternatively, the recreational accessory 32" is not a storage box but rather another relatively large and bulky recreational accessory. Other such recreational accessory may include, but is not limited to a charcoal grill, a gas grill, a cooler, a camp-stove, a non-locking storage box, etc.

Figure 18:
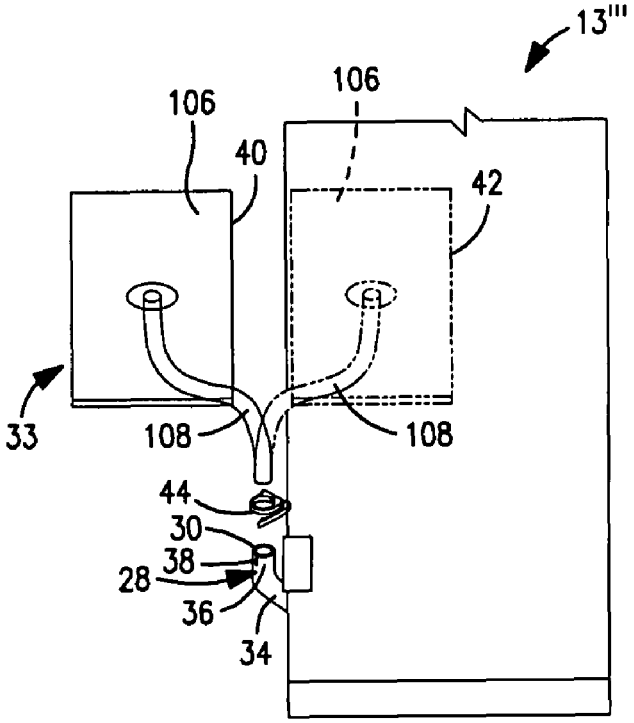
FIG. 18 is a pictorial, exploded view of a further embodiment of a recreational accessory and mounting assembly depicting the recreational accessory as being movable between a first position and a second position.
Figure 19:
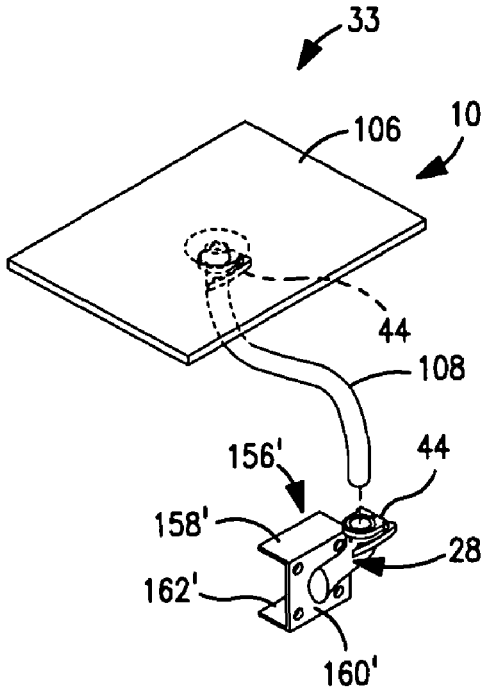
FIG. 19 is a pictorial, partially exploded view of still another embodiment of a recreational accessory and mounting assembly showing an arcuately shaped arm protruding downward from the recreational accessory.

Referring now to FIGS. 6, 18 and 19, a recreational accessory 33 is shown in the form of a table 106. The mounting assembly 12' includes an elongated arm 108 and a support brace assembly 78'. The table 106 can rotate or pivot relative to the mounting assembly 12'. Alternatively, the table 106 can be fixed relative to the pier or dock 14.

The mounting assembly 12' is attached to an outer surface 18 of the pier or dock 14. The elongated arm 108 extends generally upwardly and outwardly from the mounting assembly 12'.

The elongated arm 108 is a rigid member having a first end and a second end. The elongated arm 108 is depicted having a curved, arcuate or curvilinear profile. The elongated arm 108 can have a length which is more than 12 inches. Desirably, the elongated arm 108 has a length of from between about 12 inches to about 48 inches. More desirably, the elongated arm 108 has a length of from between about 16 inches to about 36 inches. The profile of the elongated arm 108 can be a C, an S, a V, a W, a U or any other desired profile. The elongated arm 108 connects the table 106 to the mounting assembly 12' and is adapted and configured to bear at least some of the load of the table 106 and/or objects placed thereupon. The elongated arm 108 is adapted and configured to pivot or rotate with respect to the mounting assembly 12'. The elongated arm 108 can be designed to rotate from between about 10 degrees to 360 degrees with respect to the mounting assembly 12'. The elongated arm 108 can rotate within the second member 28. Alternatively, the elongated arm 108 can be constructed from a flexible material that will allow it to bend a small amount so as to reposition the table 106 without having to rotate the elongated arm 108. The table 106 will be able to pivot or move relative to movement of the elongated arm 108.

The first end of the elongated arm 108 can be inserted into the second or upper end 36 of the mounting assembly 12'. The first end 34 of the mounting assembly 12' is secured to the C-shaped channel 58. The mounting assembly 12' curves generally outwardly away from the pier or dock 14 and extends along a generally straight-line path for a short distance to its second end 36. The elongated arm 108 has a first end 110 which is designed to be inserted into the second end 36 of the mounting assembly 12'. The elongated arm 108 extends upward and terminates at a second end 112 which is generally aligned perpendicular to the water. The second end 112 is sized, adapted and configured to be connected to the table 106.

The recreational accessory 33 includes one or more securing devices 44. As shown, a first securing device 44 communicates and cooperates with a portion of recreational accessory 33 at or adjacent the intersection of the table 106 with the second end 112 of the elongated arm 108. A second securing device 44 communicates and cooperates with a portion of recreational accessory 33 located at or adjacent to the intersection of the mounting assembly 12' and the first end 110 of the elongated arm 108. The securing devices 44 enables the components of the recreational accessory 33 to selectively either pivot, rotate, and/or otherwise move with respect to each other, or be relatively lockingly or otherwise temporarily fixed with respect to each other. Accordingly, a person can loosen, unlock, or otherwise un-secure, one of the securing devices 44, which enable the person to pivot, rotate, lift upwardly, insert inwardly, or otherwise move the elongated arm 108 with respect to the table 106 and/or the mounting assembly 12'.

It should be mentioned that in FIG. 6, the upper end of the support brace assembly 78' attaches to the second end 112 of the elongated arm 108 and not to the lower tray 76, as shown in FIG. 1. The support brace assembly 78' extends between the pier or dock 14 and the elongated arm 108. The lower end of the support brace assembly 78' is attached to one of the pilings 20 of the pier or dock 14. The upper end of the support brace assembly 78' is attached to the elongated arm 108 approximate the second end 112.

Still referring to FIG. 6, the table 106 includes a generally planar shelf-type portion, with upper and lower surfaces, and a collar 114. The collar 114 is a tubular projection which extends downwardly from the medial portion of the lower surface of the table 106. The collar 114 has a cavity which extends axially thereinto. The cavity is adapted and configured to accept the second end of the elongated arm 108 therein. In addition, the cavity of the collar 114 enables the table 106 to pivot and/or otherwise rotate about a generally upright, vertical, axis of pivotation. Alternatively, the collar 114 can be fixed or secured to the elongated arm 108 by a fastener. The fastener can be a pin, a key, a bolt, one or more screws, or other suitable hardware, or by a weld or an adhesive, or any other type of fastener known to those skilled in the art.

In yet other embodiments, the table 106 does not include the collar 114. In this embodiment, the uppermost end of the elongated arm 108 can include a flange, which extends radially outwardly therefrom, which is fixedly mounted to the bottom surface of the table 106. Alternatively, the second end 112 of elongated arm 108 can include a swivel-plate or some other turn-table type device, which is mounted to the bottom surface of the table 106. This structure enables the table 106 to pivot, rotate, and/or otherwise move with respect to the elongated arm 108.

Figure 20:
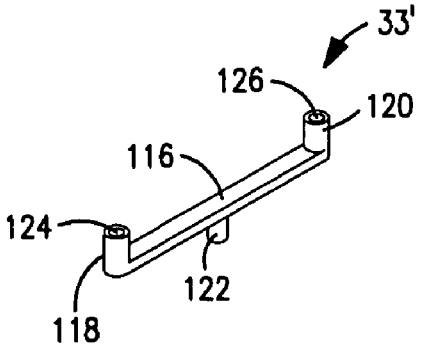
FIG. 20 is a perspective view of a cross bar which can support one or more recreational accessories.

Referring now to FIG. 20, a recreational accessory 33' is shown consisting of a crossbar 116, a first canister 118, a second canister 120 and a projection 122. The crossbar 116 has first and second ends which define a length dimension therebetween, a width dimension, a thickness dimension, and upper and lower surfaces. The first and second canisters, 118 and 120 respectively, are generally cylindrical and elongated in configuration.

The length dimension of the canisters 118 and 120 extends in a direction which is generally perpendicular to the direction of the length dimension of the crossbar 116. The first and second canisters, 118 and 120 extend upwardly from the upper surface of the crossbar 116, adjacent to the first and second ends of the crossbar 116 and generally parallel to each other.

A blind bore 124 is formed in the first canister 118 and a blind bore 126 is formed in the second canister 120. Each of the bores 124 and 126 extends downward from the upper surface of the respective canisters 118 and 120 into each of the canisters 118 and 120. Each of the bores 124 and 126 is adapted and configured to receive various articles therein, including, but not limited to: a flagpole, an umbrella pole, a low voltage lighting fixture, a high voltage light fixture, a bird-feeder mounting pole, a plant-hanging mounting pole, etc. Accordingly, the exact dimensions and characteristics of the first and second canisters, 118 and 120 respectively, are selected to correspond to the desired qualities and characteristics based at least in part on the intended use, intended use environment, and duration of the intended use-life.

It should be understood that each bore 124 and 126 can hold a recreational accessory or the two bores 124 and 126 can cooperate to hold a single recreational accessory.

The projection 122 extends generally downwardly from a medial portion of the lower surface of the crossbar 116. The projection 122 is adapted and configured to enable a person to removably attach a recreational accessory 33' to the desired mounting mechanism.

The projection 122 is generally elongated in profile and has an outer circumferential surface which cooperates with the inner circumferential surface of second member 28 of the various mounting assemblies 12 or 12'. In other words, the projection 122 is adapted and configured for removable, sliding, receipt into the opening formed in the hollow tubular second member 28. This structure permits the inner circumferential surface of the second member 28 to grip, frictionally engage, clamp, etc. with the interface of the outer circumferential surface of the projection 122.

Figure 21:
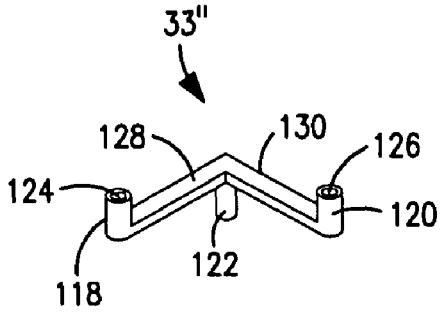
FIG. 21 is a perspective view of an alternatively configured bar which can support one or more recreational accessories.

Referring now to FIG. 21, a recreational accessory 33" is shown which includes a first bar 128, a second bar 130 which is arranged at an angle to the first bar 128, a projection 122, a first canister 118, a second canister 120. A bore 124 is formed in the first canister 118 and a bore 126 is formed in the second canister 120. The first and second canisters, 118 and 120 respectively, the projection 122 and the bore 124 and 126 are identical to those described above with reference to the recreational accessory 33' shown in FIG. 20.

Each of first and second bars, 128 and 130 respectively, has first and second ends which define a length dimension therebetween, a width dimension, a thickness dimension, and upper and lower surfaces. The first ends of the first and second bars, 128 and 130 respectively, intersect and are connected to each other. As by example, the first and second bars, 128 and 130 respectively, extend outwardly and perpendicularly away from each other. They establish a generally L-shape configuration as viewed from above. The first and second bars, 128 and 130 respectively, can be angled relative to one another from between 1 degree to about 180 degrees. When the first and second bars, 128 and 130 respectively, are arranged close to 1 degree or close to 180 degrees, they may appear to be a linear line when viewed from above. It should be understood that the first and second bars, 128 and 130 respectively, can be arranged at any desired angle relative to each other. The first and second bars, 128 and 130 respectively, intersect at one end. It should also be noted that additional bars can be added to produce various shapes, such as a double L configuration or a triple L configuration. The bars 128 and 130 can also be curved to produce a C-shaped configuration, etc.

Still referring to FIG. 21, the canisters 118 and 120, with the bores 124 and 126 extending therein, are shown as extending upward from the respective second ends of the bar members 128 and 130. The second ends are the ends of the bar 128 and 130 which are most distal each other. The bores 124 and 126 are adapted and configured to removably and/or interchangeably, hold various goods and/or articles. The articles can be a mounting pole, a hook, a flagpole, an umbrella pole, a low voltage light fixture, a high voltage light fixture, a bird-feeder, a plant-holder, a pot, a torch, a trash receptacle, a hammock, an insect-repellant container, etc.

It should be understood that each bore 124 and 126 can hold a recreational accessory or the two bores 124 and 126 can cooperate to hold a single recreational accessory. In general, the bores 124 and 126 are representative of multiple bores which can be used to support accessories. Each bore can be used to support a single accessory, or a given accessory can be supported by two, or three, or more, of the bores.

The projection 122 extends downwardly from the lower surface of the intersecting point of the bar 128 and 130. The projection 122 is adapted and configured to pivot, rotate, be removed, be inserted into or otherwise be suitably housed in various corresponding mounting assemblies 12.

Figure 10:
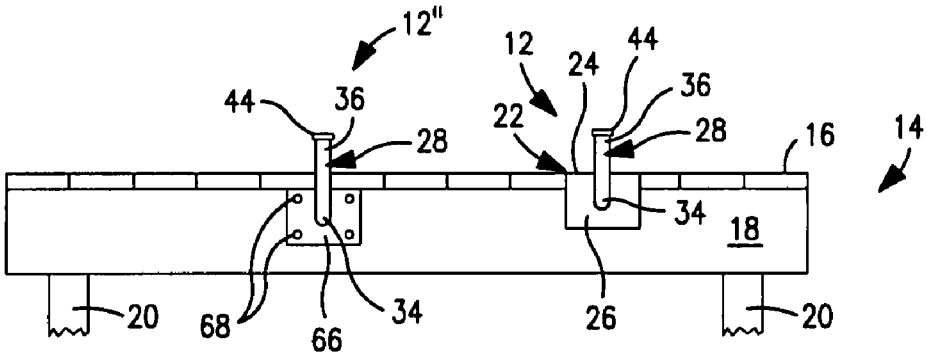
FIG. 10 is a front elevation view of two different mounting assemblies secured to a pier or dock.

Referring now to FIG. 10, two different mounting assemblies 12 and 12" are shown. Each of the mounting assemblies 12 and 12" has a single second member 28 as opposed to two or more second members as was shown in FIG. 9. The mounting assembly 12 includes an L-shaped first member 22 with a first portion 24 secured to the upper surface 16 of the pier or dock 14 and a second portion 26 positioned adjacent to the outer surface 18 of the pier or dock 14. The mounting assembly 12 has a first end 34 and a second end 36, and a securing device 44 that is optionally positioned adjacent to the second end 36.

The second portion 26 can be a generally rigid, planar, elongated member which extends generally parallel to and along a portion of an outer surface 18 of the pier or dock 14. The second portion 26 extends downwardly from the first portion 24. The second portion 26 has an inwardly facing surface, and outwardly facing surface, an upper edge surface and a lower edge surface. The lower edge surface of the second portion 26 faces downwardly and the upper edge surface, or a portion of the second portion 26 located adjacent to its outer edge, is attached to the outwardly facing edge of the first portion 24. Thus, first portion 24 and the second portion 26, in combination, define the "L-shaped" profile for the first member 22.

The second member 28 extends outwardly and upwardly away from the outwardly facing surface of second portion 26 and thus outwardly and upwardly away from the pier or dock 14. The second member 28, either alone or in combination with the securing device 44, is adapted and configured to removably receive a recreational accessory 32, 32' 32", 33, 33' or 33" therein.

The second mounting assembly 12" shown in FIG. 10 includes a mounting plate 66 and a second member 28. The mounting plate 66 is similar to that described above for FIG. 9 except that it is shorter in length. The mounting plate 66 is generally planar, has an outer surface, and inner surface, and is generally rectangular as viewed in front elevation. The mounting plate 66 extends partially along the outer surface 18 of the pier or dock 14. The inwardly facing surface of the mounting plate 66 is in face-to-face communication with the outer surface 18 of the pier or dock 14. The second member 28 has a first end 34 and a spaced apart second end 36. The first end 34 of the second member 28 is secured to the mounting plate 66 such that the second member 28 extends outwardly and upwardly away from the outer surface of the mounting plate 66.

One or more bores 68 extend through the entire thickness of the mounting plate 66 and each is adapted and configured to accept a suitable mounting hardware therethrough. The hardware (not shown) is used to secure the mounting assembly 12" to the pier or dock 14.

Figure 11:
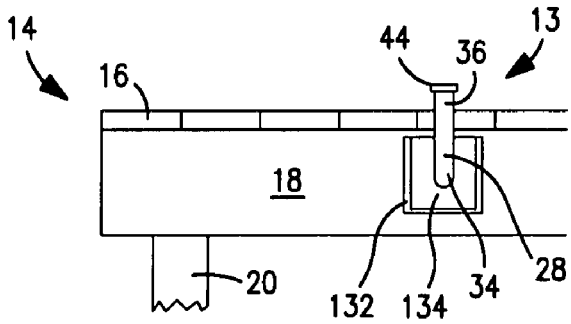
FIG. 11 is a front elevation view of still another mounting assembly secured to a pier or dock.

Referring now to FIG. 11, a different embodiment of a mounting assembly 13 is shown which includes a receiver 132, an insertion plate 134, a second member 28, and optionally, a securing device 44. The receiver 132 is attached to the outer surface 18 of the pier or dock 14. The insertion plate 134 is sized and designed to be inserted into or be received into the receiver 132. Typically, the insertion plate 134 can be slid down into the receiver 132 from the top.

Figure 12:
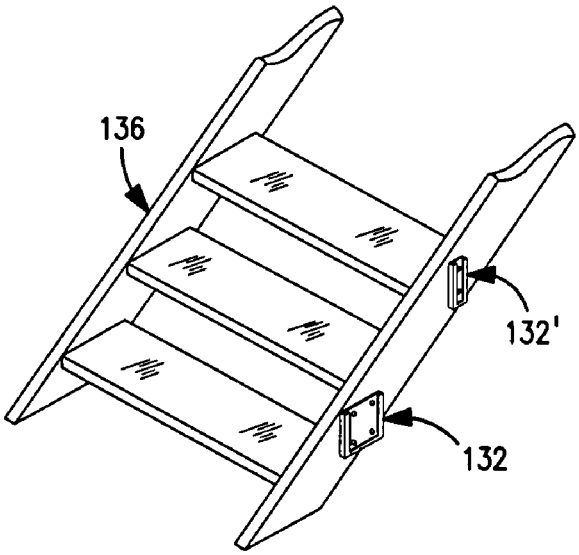
FIG. 12 is a perspective view of a staircase having another embodiment of a mounting assembly secured to a side thereof and illustrating the mounting assembly in two different sizes.

In FIG. 12, two different sizes of receivers 132 and 132' are shown secured to a staircase 136. An appropriate size insertion plate 134 cooperates with each of the two different size receivers 132 and 132' by being slid or inserted into the respective receiver 132 or 132'. This action creates a mounting and housing relationship which enables various recreational accessories 32 to be removably attached to the mounting assembly 13.

Figure 13:
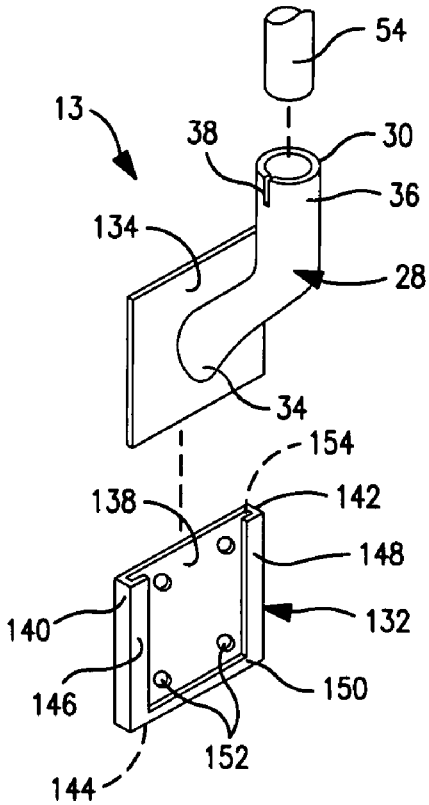
FIG. 13 is an exploded, pictorial view of the mounting assembly shown in FIG. 12 along with a portion of a projection or arm which protrudes from a recreational accessory.
Figure 14:
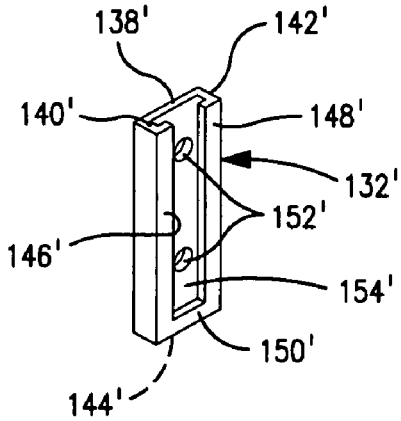
FIG. 14 is an enlarged perspective view of the narrower mounting assembly shown in FIG. 12.

Turning now to FIGS. 13 and 14, the receiver 132 is shown having a back wall 138, a first side wall 140, a second side wall 142, a bottom wall 144, a first side flange 146, a second side flange 148, and a bottom flange 150. The back wall 138 is generally planar and has a substrate facing surface, an outwardly facing surface, first and second lateral edges, a top edge and a bottom edge. One or more bores 152 extend through the thickness of back wall 138. In FIG. 13, four bores 152 are shown. The bores 152 are adapted and configured to accept mounting hardware (not shown) therethrough. The bores 152 can be countersunk into the outwardly facing surface of the back wall 138 which enables the outer-most surfaces of the mounting hardware to be aligned generally flush with respect to the outwardly facing surface of the back wall 138. The back wall 138, with the mounting hardware extending therethrough, defines a generally planar outwardly facing surface.

The first side wall 140 is an elongated member which extends along the length of back wall 138 and is situated adjacent to the first lateral edge of the back wall 138. The first side wall 140 extends generally perpendicularly outwardly from the outwardly facing surface of back wall 138. The second side wall 142 is an elongated member which extends along the length of the back wall 138 and is situated adjacent to the second lateral edge of the back wall 138. The second side wall 142 extends generally perpendicularly outwardly from the outwardly facing surface of the back wall 138, generally parallel to the first side wall 140.

The bottom wall 144 is an elongated member which extends along all or part of the width of back wall 138 and adjacent to the lower edge of the back wall 138. The bottom wall 144 can include one or more holes or slots, e.g. at or close to the back of the bottom wall 144, thus to provide such additional features as mounting slots for mounting the back wall to the bottom wall, drainage slots, and/or security apertures such as for mounting a padlock or other locking device. The bottom wall 144 extends generally outwardly from the outwardly facing surface of the back wall 138. A first end of the bottom wall 144 communicates with a respective end of the first side wall 140 and a second end of the bottom wall 144 communicates with a respective end of the second side wall 142. This construction permits the bottom wall 144 to span across and connect the first and second side walls, 140 and 142 respectively, on opposite lateral sides of the back wall 138.

The first side flange 146 is an elongated member having first and second lateral edges. The first side flange 146 extends along a plane which is generally parallel to the back wall 138. The length of the first side flange 146 is equal the length of the back wall 138 and is also equal to the length of the first side wall 140. The first lateral edge of the first side flange 146 is connected to the outwardly most extending portion of the first side wall 140. From the point of intersection with the first side wall 140, the first side flange 146 extends inwardly toward the medial portion of the back wall 138, parallel to and spaced apart from the back wall 138.

The second side flange 148 is an elongated member having first and second lateral edges. The second side flange 148 extends along a plane which is generally parallel to the back wall 138, generally coplanar with the first side flange 146. The length of second side flange 148 is equal to the length of the back wall 138 and is also equal to the length of the second side wall 142. The first lateral edge of the second side flange 148 is connected to the outwardly most extending portion of the second side wall 142. From the point of intersection with the second side wall 142, the second side flange 148 extends inwardly toward the medial portion of the back wall 138 and thus toward the first side flange 146, parallel to and spaced apart from the back wall 138.

The bottom flange 150 is an elongated member having an upper edge and a lower edge. The bottom flange 150 extends parallel to and is spaced apart from the back wall 138. The lower edge of the bottom flange 150 is connected to the outwardly most extending portion of the bottom wall 144.

A first end of the bottom flange 150 communicates with a respective end of the first side flange 146 and a second end of the bottom flange 150 communicates with a respective end of the second side flange 148. This construction permits the bottom flange 150 to span across and connect the first and second side flanges, 146 and 148 respectively, on opposite lateral sides of the back wall 138. The bottom flange 150 is also connected to the back wall 138 along its entire length.

The outwardly facing surface of the back wall 138, the inwardly facing surfaces of the first and second side walls, 140 and 142 respectively, the upwardly facing surface of the bottom flange 150, the mounting substrate facing surfaces of the first and second side flanges, 146 and 148 respectively, and the bottom flange 150, generally define the outer perimeter of a cavity 154. In other words, the cavity 154 is a void which extends from the outwardly facing surface of the back wall 138, outwardly toward the surfaces of the first and second side flanges, 146 and 148 respectively. The width of the cavity 154 extends between the inner surfaces of the first and second side walls, 140 and 142 respectively. The cavity 154 is adapted and configured to receive and removably house the insertion plate 134 therein.

Referring now to FIGS. 12 and 14, the receiver 132' is shown which is similar to the receiver 132 but has a width that is relatively smaller in magnitude than that of receiver 132. The receiver 132' includes a back wall 138', a first side wall 140', a second side wall 142', a bottom wall 144', a first side flange 146', a second side flange 148', and a bottom flange 150'. The back wall 138' is generally planar and has a substrate facing surface, an outwardly facing surface, first and second lateral edges, a top edge and a bottom edge.

One or more bores 152' extend through the thickness of the back wall 138'. Four bores 152' are depicted in FIG. 14. The bores 152' are adapted and configured to accept mounting hardware (not shown) therethrough. The bores 152' can be countersunk into the outwardly facing surface of the back wall 138', if desired, which enables the outer-most surfaces of the mounting hardware to sit generally flush with respect to the outwardly facing surface of the back wall 138'. This construction permits the back wall 138', with the mounting hardware extending therethrough, to define a generally planar outwardly facing surface.

The first side wall 140' is an elongated member which extends along the length of the back wall 138' and adjacent to the first lateral edge of the back wall 138'. The first side wall 140' extends generally perpendicularly outwardly from the outwardly facing surface of the back wall 138'. The second side wall 142' is also an elongated member which extends along the length of the back wall 138' and adjacent to the second lateral edge of the back wall 138'. The second side wall 142' extends generally perpendicularly outwardly from the outwardly facing surface of the back wall 138', generally parallel to the first side wall 140'.

The bottom wall 144 is an elongated member which extends along all or part of the width of back wall 138 and adjacent to the lower edge of the back wall 138. The bottom wall 144 can include one or more holes or slots, e.g. at or close to the back of the bottom wall, thus to provide such additional features as mounting slots for mounting the back wall to the bottom wall, drainage slots, and/or security apertures such as for mounting a padlock or other locking device. The bottom wall 144' extends generally outwardly from the outwardly facing surface of back wall 138'. A first end of the bottom wall 144' communicates with a respective end of the first side wall 140' and a second end of the bottom wall 144' communicates with a respective end of the second side wall 142'. This construction permits the bottom wall 144' to span across and connect the first and second side walls, 140' and 142' respectively, on opposite lateral sides of the back wall 138'.

The first side-flange 146' is an elongated member having first and second lateral edges. The first side-flange 146' extends along a plane which is generally parallel to the back wall 138'. The length of the first side flange 146' is equal to the length of back wall 138' and is also equal to the length of the first side wall 140'. The first lateral edge of the first side flange 146' is connected to the outwardly most extending portion of the first side wall 140'. From the point of intersection with the first side wall 140', the first side flange 146' extends inwardly toward the medial portion of the back wall 138', parallel to and spaced apart from the back wall 138'.

The second side flange 148' is an elongated member having first and second lateral edges. The first side-flange 146' extends along a plane which is generally parallel to the back wall 138', generally coplanar with the first side flange 146'. The length of the second side flange 148' is equal to the length of the back wall 138' and is also equal to the length of the second side wall 142'. The first lateral edge of the second side flange 148' is connected to the outwardly most extending portion of the second side wall 142'. From the point of intersection with the second side wall 142', the second side flange 148' extends inwardly toward the medial portion of the back wall 138' and thus toward the first side flange 146', parallel to and spaced apart from the back wall 138'.

The bottom flange 150' is an elongated member having an upper edge and a lower edge. The first side-flange 146' extends parallel to and is spaced apart from the back wall 138'. The lower edge of the bottom flange 150' is connected to the outwardly most extending portion of bottom wall 144'.

A first end of the bottom flange 150' communicates with a respective end of the first side flange 146' and a second end of the bottom flange 150' communicates with a respective end of the second side flange 148'. This construction permits the bottom flange 150' to span across and connect the first and second side flanges, 146' and 148' respectively, all of which are spaced from and generally parallel to the back wall 138'.

The outwardly facing surface of the back wall 138', the inwardly facing surfaces of the first and second side walls, 140' and 142' respectively, the upwardly facing surface of the bottom flange 150', the mounting substrate facing surfaces of the first and second side flanges, 146' and 148' respectively, and the bottom flange 150', generally define the outer perimeter of a cavity 154'. In other words, the cavity 154' is a void which extends from the outwardly facing surface of the back wall 138', outwardly to the surfaces of the first and second side flanges, 146' and 148' respectively, which face the back wall 138', and is laterally defined between the surfaces of the first and second side walls 140' and 142' respectively. The cavity 154' is adapted and configured to receive and removably house insertion plate therein.

The insertion plate 134 is a generally planar member, and based on the particular intended application, has overall dimensions which correspond to the respective dimensions of the cavity 154 and 154'. The insertion plate 134 has an inner surface, an outer surface, upper and lower portions which generally define a length dimension therebetween. The first and second lateral portions of the insertion plate 134 generally define a width dimension therebetween. Accordingly, the width dimensions of the insertion plates 134 are adapted and configured for use in combination with the receiver 132 and are relatively greater than corresponding width dimensions of the insertion plate 134 which is adapted and configured for use in combination with the receiver 132.

Returning to FIG. 13, the second member 28 extends outwardly and upwardly from a medial portion of the outwardly facing surface of the insertion plate 134. The second member 28 is adapted and configured to receive a projection 54 or some other suitably adapted and configured projecting members attached to a recreational accessory 32. As in all other embodiments, the mounting assembly 13 can include a securing device 44 (not shown) which can grip, frictionally engage, or otherwise hold a projection 54, which is secured to a recreational accessory 32, to the second member 28.

In the complete assemblage of the mounting assembly 13, the insertion plate 134 can be inserted and later be removed from the receiver 132. When the insertion plate 134 is so housed in the receiver 132, the lower edge of the insertion plate 134 rests upon the upwardly facing surface of the bottom wall 144, whereby the bottom wall 144 bears at least a portion of the load of the insertion plate 134 and components attached thereto. The first and second side walls, 140 and 142 respectively, provide a mechanical mechanism for resisting and/or preventing the insertion plate 134 from laterally shifting or otherwise moving outside of the cavity 154. Namely, this is accomplished through the mechanical interfacing of the lateral edges of the insertion plate 134 and the inwardly facing surfaces of the first and second side walls, 140 and 142.

The first and second side flanges 146 and 148, and the bottom flange 150, generally capture parts of the outwardly facing surface of the insertion plate 134 located adjacent to the lower and lateral edges of the insertion plate 134. Thus, the first and second side flanges, 146 and 148 respectively, and the bottom flange 150, either separately or in combination, provide a mechanical mechanism for resisting or preventing the insertion plate 134 from shifting or otherwise moving outside of the cavity 154. In other words, the insertion plate 134 is at least partially enveloped, enclosed, bordered, captured, housed, encased, and/or otherwise surrounded by at least one of the first and second side walls, 140 and 142 respectively, the bottom wall 144, and the first and second side flanges 146 and 148 respectively.

Accordingly, to use the mounting assembly 13, the user inserts the lower portion of the insertion plate 134 into the opening defined at the uppermost surface of receiver 132 which opens into the cavity 154. The user continues to slide the insertion plate 134 downwardly into the receiver 132 until the lower edge of the insertion plate 134 abuts or contacts the upwardly facing surface of the bottom wall 150. Correspondingly, this procedure is generally performed in the reverse order of operations to withdraw the insertion plate 134 from receiver 132. Namely, the user urges the insertion plate 134 upwardly until the insertion plate 134 is entirely removed from the cavity 154.

It should be understood that the procedure for inserting and withdrawing an insertion plate into and from the receiver 132' shown in FIG. 14 is identical to that described above with reference to FIG. 13.

Figure 15:
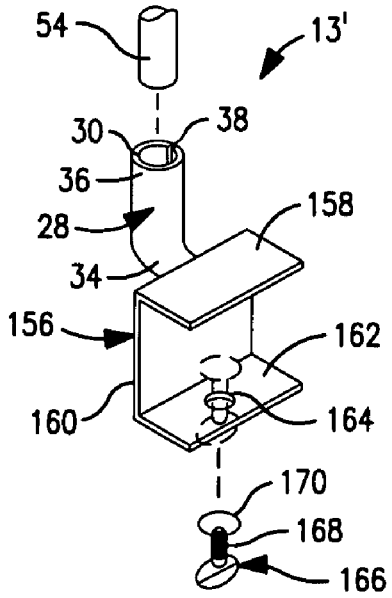
FIG. 15 is a perspective view of a mounting assembly employing a C-shaped channel bracket and a thumbscrew to secure the mounting assembly to a substrate.

Referring now to FIG. 15, a mounting assembly 13' is shown which includes a C-shaped channel bracket 156, a second member 28, and optionally, a securing device 44 (not shown). The second member 28 has a first end 34 and a spaced apart second end 36. A slit 38 is formed in the outer wall 30 of the second end 36, as described above, so as to be able to receive a projection 54. Normally the projection is secured to a recreational accessory 32 (not shown). The C-shaped channel bracket 156 can be a piece of "channel" stock, or any other suitable rigid member which has a C-shaped or U-shaped profile. The profile of the C-shaped channel bracket can be squared off to resemble a half of a rectangle. Other suitable profiles can also be employed. The C-shaped channel bracket 156 includes a first portion 158, a second portion 160 and a third portion 162.

The first portion 158 is a generally rigid, planar, elongated member which extends generally parallel to and along a portion of the upper surface 16 of the pier or dock 14. The first portion 158 has an upper surface, a lower surface, a substrate facing edge and an outwardly facing edge. The substrate facing edge generally faces toward the pier or dock 14 or other mounting substrate, and the outwardly facing edge faces generally outwardly away from the pier or dock 14 or other mounting substrate.

The second portion 160 is a generally rigid, planar, elongated member which extends generally parallel to and along a portion of the outwardly facing surface of the pier or dock 14 and extends downwardly from the first portion 158. The second portion 160 has an inwardly facing surface, and outwardly facing surface, an upper edge surface and a lower edge surface. The lower edge surface of the second portion 160 is located approximate to the water, and the upper edge surface, or a section of the second portion 160 located adjacent to its outer edge, is attached to the outwardly facing edge of the first portion 158.

The third portion 162 is a generally rigid, planar, elongated member which extends generally parallel to and along a portion of the lower surface of the pier or dock 14, generally parallel to the first portion 158. The third portion 162 has an upper surface, a lower surface, a substrate facing edge and an outwardly facing edge. The substrate facing edge generally faces toward the pier or dock 14 and the outwardly facing edge faces generally outwardly away from the pier or dock 14. The outwardly facing edge of the third portion 162 is attached to the lower edge surface of second portion 160, whereby the first, second and third portions, 158, 160 and 162, in combination, generally define the C-shaped channel bracket 156.

The second member 28 extends outwardly and upwardly away from second portion 160 of the C-shaped channel bracket 156. The second member 28 is adapted and configured to receive the projection 54. The projection 54 can be inserted, rotated, pivoted, be removable, and/or otherwise be housed within the second member 28.

Still referring to FIG. 15, the mounting assembly 13' further includes a threaded bore 164. The threaded bore 164 extends through the entire thickness of a medial portion of third portion 162. A thumbscrew 166, having a treaded shaft 168 and a disc-like upper surface 170, is retained in the threaded bore 164. Accordingly, when a person rotates the thumbscrew 166 in a first direction, the thumbscrew 166 will advance in the threaded bore 164 in a direction toward the first portion 158. Likewise, when a person rotates the thumbscrew 166 in an opposite direction, the thumbscrew 166 will regress in the threaded bore 164 in a direction away from the first portion 158.

The C-shaped channel bracket 156 generally encapsulates a portion of the pier or dock 14, whereby the first portion 158 generally superposes, or otherwise lies over or upon, the upper surface 16 of the pier or dock 14. The third portion 162 lies generally below or underneath the lower surface of the pier or dock 14. When the thumbscrew 166 is utilized, the third portion 162 is spaced vertically apart from the lower surface of the pier or dock 14 by a distance which is at least as great in magnitude as the magnitude of the thickness dimension of the disc-like upper surface 170 of the thumbscrew 166.

As a person tightens the thumbscrew 166, the C-shaped channel bracket 156 will securely attach to the pier or dock 14. The C-shaped channel bracket 156 will clamp, pinch, frictionally engage, and/or otherwise, connect the mounting assembly 13' to the pier or dock 14. The interfacing relationship between the C-shaped channel bracket 156 and the respective surfaces of the pier or dock 14, along with the tightening the thumbscrew 166 will allow for a quick and easy attachment of the mounting assembly 13'. Since the thumbscrew 166 can likewise be easily loosened, it enables the mounting assembly 13' to be easily removed from the pier or dock 14 as well.

Figure 16:
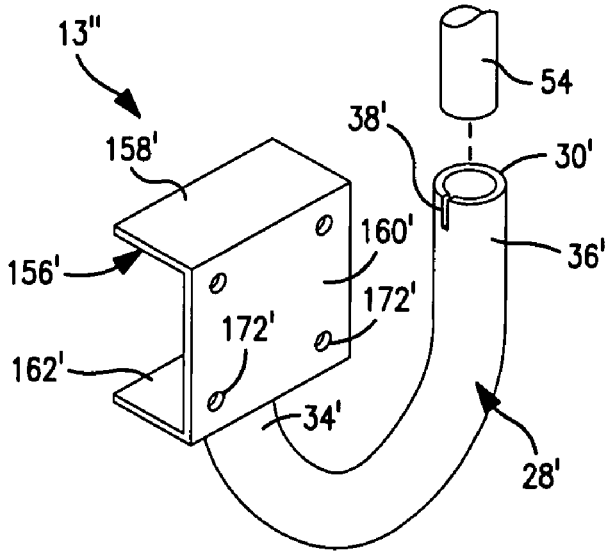
FIG. 16 is a perspective view of still another embodiment of a mounting assembly having a C-shaped channel bracket and an attachment member secured to a lower portion thereof.

Referring now to FIG. 16, a mounting assembly 13" is shown which includes a C-shaped channel bracket 156' and a second member 28'. In the mounting assembly 13", the second member 28' extends from the lower surface of the third portion 162'. The second member 28' has an outer wall 30', a first end 34' and a spaced apart second end 36'. A slit 38' is formed in the second end 36' in a similar fashion as the slit 38' was formed in the second member 28'. In this embodiment, the first end 34' of the second member 28' is attached to the third portion 162' and extends first downwardly away from the third portion 162'. The second member 28' then curves outwardly away from the C-shaped channel bracket 156' and finally extends upwardly, terminating at the second end 36' which faces generally upwardly. The slit 38' is adapted and configured to slidingly receive a projection 54 which is secured to a recreational accessory 32 (not shown). As illustrated, the second member 28' has an arcuate portion located between its first and second ends, 34' and 36' respectively, which curves and extends about approximately 180 degrees, terminating in the upwardly turned, second end portion 36'.

One or more bores 172 are formed through the entire thickness of second portion 160'. Four bores 172 are shown in FIG. 16. The second portion 160' is adapted and configured to accept mounting hardware (not shown) therethrough. The hardware enables the C-shaped channel bracket 156' to be fixed, mounted, or otherwise to be secured to the pier or dock 14. The bores 172 can be formed through one of first and/or third portions, 158' and/or 162' respectively, in lieu of, or in addition to being formed through the second portion 160'.

Referring now to FIG. 17, a mounting assembly 13'" is shown for attachment to a pier or dock 14. The mounting assembly 13'" includes a C-shaped channel bracket 156' having a first portion 158', a second portion 160' and a third portion 162'. Four bores 172 are formed in the second portion 160' and the bores 172 extend completely through the second portion 160'. The bores 172 are sized and shaped to receive hardware such as screws, nails, bolts, etc. to secure the C-shaped channel bracket 156' to the pier or dock 14. The mounting assembly 13'" is similar to that illustrated in FIG. 16 except that the second member 28 is secured to the second portion 160'. As shown, the second member 28 extends outwardly and upwardly away from the outwardly facing surface of the second portion 160'.

To use the mounting assembly 13''', a person will first select the desired spot on the pier or dock 14 to place the C-shaped channel bracket 156'. As mentioned earlier, this description is directed to the pier or dock 14 but any other substrate could be used. Such other substrates include but are not limited to: decks, stairs, staircases, patios, walkways, elevated walkways, tunnels, boats, cars, trucks, wagons, tractors, etc. Likewise, the recreational accessory that can be removably secured to the mounting assembly 13''' can also vary.

Once the spot on the pier or dock 14 is selected and the exact recreational accessory 32 is selected, the person would install or attach the mounting assembly 13''' to the pier or dock 14. Namely, the person would position the C-shaped channel bracket 156' against the upper and outer surfaces, 16 and 18 respectively, of the pier or dock 14 and use adequate hardware to attach the second portion 160' of the C-shaped channel bracket 156' to the outer surface 18 of the pier or dock 14.

The person would then removably secure, optionally non-removably attach, a recreational accessory 32 to the second member 28. A person could do this by inserting a projection 54 or 122, or the elongated arm 108 (Not Shown) into the second end 36 of the second member 28. A securing device 44 is then tightened about the outer wall 30 of the second end 36 of the second member 28. This is accomplished by rotating the bolt 48 which engages with a threaded bore formed in the securing device 44. As the securing device 44 is tightened, the slit 38 will get smaller and the outer wall 30 of the second member 28 will snugly engage with the projection 54 or 122. This action will secure the projection 54 or 122, along with the recreational accessory 32 that is secured to it, to the second member 28.

The person who has installed the recreational accessory and mounting assembly 10 can then enjoy the benefits of using the recreational accessory 32 as desired.

For example, when a person uses the recreational accessory 32 as shown in FIGS. 1 and 8, the person can move the upper tray assembly 72 from a first position 40 to a second position 42. In the first position 40, the upper tray assembly 72 lies over or superposes the water while in the second position 42, the upper tray assembly 72 lies above and superposes the pier or dock 14.

Referring now to FIGS. 18 and 19, when a person uses the mounting assembly 13''', the person can move the table 106 from the first position 40, wherein the table 106 does not lie over or superpose the pier or dock 14, to the second position 42, wherein the table 106 lies over and superposes the pier or dock 14.

As yet another example, a person could remove a recreational accessory 32 from the mounting assembly 13''' and replace it with another, for example a different recreational accessory 32. This is done by removing the recreational accessory 32 from the mounting assembly 13'''. The person would then insert the elongated arm 108 from another recreational accessory 32 into the second member 28. In the case where the mounting assembly 13 is as depicted in FIGS. 12-14, the person could remove the first recreational accessory 32 by sliding the insertion plate 134 out of the receiver 132 or 132' and then inserting a new insertion plate 134, to which is attached a different recreational accessory, into the receiver 132 or 132'.

Preferably, the recreational accessory and mounting assembly 10 is made from materials which resist corrosion and are suitably strong and durable for normal extended use. Those skilled in the art are well aware of certain metallic and non-metallic materials which possess such desirable qualities. Appropriate methods of forming such materials are well known to those skilled in the art.

Appropriate metallic materials for components of the recreational accessory and mounting assembly 10 include, but are not limited to: anodized aluminum, aluminum, steel, stainless steel, titanium, magnesium, brass, and their respective alloys. Common industry methods of forming such metallic materials include: casting, forging, shearing, bending, machining, riveting, welding, powdered metal processing, extruding, etc.

Non-metallic materials suitable for constructing components of the recreational accessory and mounting assembly 10 include: various polymeric compounds, such as polyolefins. Polyolefins include polyethylene, high density polyethylene, polypropylene, high density polypropylene, and combinations of polyethylene and polypropylene. The recreational accessory and mounting assembly 10 can also be formed from polymers, such as polyvinyl chloride, chlorinated polyvinyl chloride copolymers, various polyamides, polycarbonates, etc.

For any polymeric material employed in constructing the recreational accessory and mounting assembly 10, any conventional additive package can be included, such as: slip agents, anti-block agents, release agents, anti-oxidants, fillers, and plasticizers to control processing of the polymeric material or to stabilize and/or otherwise control the properties of the finished processed product. The additive can also be added to control hardness, bending resistance, and the like.

Common industry methods of forming such polymeric compounds will suffice to form non-metallic components of the recreational accessory and mounting assembly 10. Exemplary, but not limiting, of such processes are the various commonly-known plastics converting processes.

The recreational accessory and mounting assembly 10 can be manufactured as individual components. The individual components are then assembled as sub-assemblies, including but not limited to: the mounting assembly 12, the securing device 44, the recreational accessories 32, 32', 32", 33, 33' and 33", as well as others. Each of the aforementioned sub-assemblies is then assembled to other sub-assemblies to form the recreational accessory and mounting assembly 10.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A recreational accessory and mounting assembly for attachment to a substrate having an upper surface and an outer surface, comprising:

a) a mounting assembly including a first rigid member having a first portion and a second portion, said first portion being secured to said upper surface of said substrate and extending parallel to and along a portion of said upper surface of said substrate, and said second portion extending downward from said first portion and extending parallel to and along a portion of said outer surface of said substrate, and a second rigid member having a first end and a second end, said first end of said second rigid member being secured to said second portion of said first rigid member, said second rigid member extending outward from said first rigid member, and said second rigid member being a hollow tubular member having a circumferential outer wall;

b) a recreational accessory movably mounted to said second end of said second rigid member, said recreational accessory being movable between a first position and a second position, wherein in said first position, said recreational accessory does not superpose said upper surface of said substrate and in said second position, said recreational accessory superposes at least a portion of said upper surface of said substrate; and c) a securing device positioned about said second end of said second rigid member, said securing device adapted to secure said recreational accessory to said second rigid member, said securing device is movable between a first position and a second position, in said first position, said securing device locks said recreational accessory to said second rigid member, and in said second position, said securing device unlocks said recreational accessory from said second rigid member thereby permitting movement between said recreational accessory and said second rigid member.

2. The recreational accessory and mounting assembly of claim 1 wherein said first portion of said first rigid member is secured to said upper surface of said substrate and a said second portion of said first rigid member is positioned adjacent to said outer surface of said substrate for supporting a portion of the weight of said recreational accessory, said second portion being aligned at 90 degrees to said first portion, and said second rigid member is an elongated, bent member with an angle of from between about 45 degrees to about 110 degrees relative to said outer surface of said substrate.

3. The recreational accessory and mounting assembly of claim 1 wherein said securing device is a quick release clamp, and said recreational accessory and mounting assembly further includes a support brace assembly positioned between said recreational accessory and said outer surface of said substrate, said support brace assembly acting as a load bearing member.

4. The recreational accessory and mounting assembly of claim 1 wherein said second rigid member has an arcuate profile with two straight portions having a curved portion located therebetween, and said first end of said second rigid member is secured to said second portion of said first rigid member and said second end is removably attached to said recreational accessory and secured thereto by a quick release clamp.

5. The recreational accessory and mounting assembly of claim 4 wherein said second rigid member is angled at about 45 degrees between said first and second ends.

6. The recreational accessory and mounting assembly of claim 5 wherein said second rigid member has a slit formed through said circumferential outer wall, said slit being located adjacent to and perpendicular to said second end, said slit having a thickness of at least 0.1 millimeters and a length of from between about 0.25 inches to about 1 inch, and said slit allowing said second end to have a degree of flexibility when another member is inserted into said second end.

7. The recreational accessory and mounting assembly of claim 1 wherein said recreational accessory can move along a straight linear travel path between said first and second positions, and said linear path is aligned parallel to said upper surface of said substrate.

8. The recreational accessory and mounting assembly of claim 1 wherein said recreational accessory can pivot between said first and second positions.

9. The recreational accessory and mounting assembly of claim 1 wherein said recreational accessory can rotate between said first and second positions.

10. The recreational accessory and mounting assembly of claim 1 wherein said recreational accessory is a movable shelf aligned vertically below the upper surface of said substrate, said shelf being movable from a first position wherein it is located beneath said substrate to a second position wherein it is cantilevered outward away from said substrate.

11. The recreational accessory and mounting assembly of claim 10 wherein said movable shelf has a handle secure thereto, said handle assisting in moving said shelf between said first and second positions.

* * * * *